US012168944B1

(12) United States Patent
Wu et al.

(10) Patent No.: US 12,168,944 B1
(45) Date of Patent: Dec. 17, 2024

(54) ABSORPTION CARNOT BATTERY

(71) Applicant: City University of Hong Kong, Hong Kong (HK)

(72) Inventors: Wei Wu, Hong Kong (HK); Yunren Sui, Hong Kong (HK); Haosheng Lin, Hong Kong (HK); Zhixiong Ding, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 0 days.

(21) Appl. No.: 18/389,833

(22) Filed: Dec. 20, 2023

(51) Int. Cl.
*F01K 3/12* (2006.01)
*F01K 3/00* (2006.01)

(52) U.S. Cl.
CPC ..... *F01K 3/12* (2013.01); *F01K 3/006* (2013.01)

(58) Field of Classification Search
CPC ..... F01K 3/12; F01K 3/006
See application file for complete search history.

(56) References Cited

U.S. PATENT DOCUMENTS

2014/0352304 A1* 12/2014 Arias ..... F24S 23/74 60/645
2017/0284707 A1* 10/2017 Brenner ..... F25B 15/06
2023/0069597 A1* 3/2023 Wu ..... F25B 37/00

FOREIGN PATENT DOCUMENTS

CN 103090582 B * 10/2015

OTHER PUBLICATIONS

English Translation CN-103090582-B (Year: 2015).*

* cited by examiner

*Primary Examiner* — Shafiq Mian
(74) *Attorney, Agent, or Firm* — Idea Intellectual Limited; Margaret A. Burke; Sam T. Yip

(57) ABSTRACT

The present invention provides an absorption-desorption based Carnot battery designed to achieve a high-efficiency, large-density, and low-loss conversion battery system for power-heat-power purpose. Based on the rational operating strategies, the current Carnot battery system design demonstrates outstanding energy storage density and round-trip efficiency, while the self-discharging loss is minimal even after prolonged standby time. The battery system of the present invention also enables further designs with flexibility in adopting different operating modes for versatile functions to provide electricity, heating, and cooling.

14 Claims, 20 Drawing Sheets
(19 of 20 Drawing Sheet(s) Filed in Color)

ABSORPTION CARNOT BATTERY

FIELD OF THE INVENTION

The present invention relates to an energy storage system, more specifically with an absorption-desorption-based Carnot battery designed to achieve a high-efficiency, high-density, and low-loss battery system for power-heat-power conversion.

BACKGROUND

Energy storage batteries are, by definition, devices that are designed to store electrical energy in the form of chemical energy, potential energy, or thermal energy, which can then be re-converted into electricity through reversible chemical reaction. These batteries are generally designed to be rechargeable, and can be used in a wide variety of appliances, from portable devices to stationary systems.

Energy storage batteries are beneficial in multiple ways. First, due to its flexibility in charging and discharging, by storing excess electrical energy during periods of low demand, and releasing the stored electricity during peak periods of demand, the grid could be balanced and overall grid stability could be achieved.

Another application for energy storage systems is to serve as backup power sources, which are vital to the sustaining of critical operations, for example healthcare and telecommunications services, during outages. The above is a non-exhaustive list of the multiple advantages of using energy storage systems.

Against the backdrop of the global energy transition towards carbon neutrality, the majority of countries have undertaken substantial efforts to develop power production systems with an increasing fraction of renewable energy sources including solar and wind energy. However, the high penetration of renewable energy presents significant challenges to the stability of the power grid due to its intermittent and variable characteristics.

Accordingly, energy storage technologies, as described above, are widely considered as one of the most feasible solutions to enhance the flexibility of the power system and facilitate the decarbonization of the power grid.

There are several solutions available for electrical energy storage. Pumped hydro energy storage (PHES) is a mature technology with a worldwide installed capacity of 127 GW, capable of storing approximately 9000 GWh. However, despite offering low cost, high efficiency, and high technology readiness level, the further deployment of PHES technologies is bound to available geographical locations. This geographical limitation also applies to compressed air energy storage (CAES) technology. For electrochemical battery technology, the high costs and short lifespans limit large-scale applications.

Recently, Carnot batteries, which store electricity in the form of thermal energy, stand out as novel renewable energy storage technologies with low costs, long lifespans, and no geographical constraints.

The Carnot battery technologies (power to heat to power) can be categorized into four main types: Brayton pumped thermal energy storage (Brayton PTES), Rankine pumped thermal energy storage (Rankine PTES), liquid air energy storage (LAES), and thermochemical energy storage (TCES) technologies.

Brayton PTES operates a reversible Brayton cycle between hot and cold thermal reservoirs. Compared to other Carnot battery technologies, the charging process of a typical Brayton PTES occurs at higher temperatures (usually 1000° C.), contributing to a high round-trip efficiency (RTE) and medium electrostatic discharge (ESD). But currently, few available compressors can achieve high efficiencies under such high discharging temperatures imposed by Brayton PTES. The high-temperature requirement of the compressor/expander also leads to the high cost of this technology.

In contrast to the Brayton PTES, the discharging process of Rankine PTES is based on the Rankine cycle. Therefore, it generally achieves a lower RTE and ESD at much lower operating temperatures. Because the operating temperatures are often lower than 200° C. in Rankine PTES, integration of low-grade thermal energy is more convenient. Furthermore, the high TRL of the low-temperature heat pump cycle and Rankine cycle make the Rankine PTES more feasible for practical applications.

LAES technology stores electrical energy in the form of liquid air. During the charging process, the ambient air is compressed and cooled into liquid air, while in the discharging process, the stored liquid air is evaporated with the heating of stored or external heat, and finally generates power by expanding through a turbine. Compared to the PTESs, LAES provides a higher ESD but a lower RTE due to the heat loss in the evaporation and liquefaction processes. To recover the heat loss, additional heat/cold energy storage systems are commonly integrated into the LAES, leading to a higher initial cost. A LAES system with a capacity of 2.5 MWh has been successfully implemented based on the Claude cycle, but its experimental RTE is much lower than expected.

The current configurations of the aforementioned three Carnot battery technologies typically consist of three sub-cycles: heat-generation, heat-storage, and power-generation sub-cycles. Their complex configurations and numerous components make them bulky and uneconomic. Besides, storing energy in the form of temperature difference is beneficial for cost reduction but brings out high SDRs (self-discharging rates during the standby process). For instance, a Brayton PTES system can experience an SDR of 1% of the stored heat per day, rendering it unsuitable for long-term storage. Notably, the TCES technologies based on thermochemical processes offer the advantages of compact configuration and small heat loss due to the stable thermochemical form in which energy is stored.

Therefore, the previous Carnot batteries suffer from low round-trip efficiency, low energy storage density, and large heat loss. The present invention, a novel Carnot battery design is proposed based on the absorption-desorption processes, addresses this need.

SUMMARY OF THE INVENTION

Addressing the above technical insufficiencies, the present invention provides a novel Carnot battery system based on absorption-desorption processes for energy storage. The system is structurally designed to operate in a four-process cycle, each involving different configurations of the elements. The system demonstrates outstanding performance and efficiency with minimal loss, and its design also allows great flexibility in adopting different operating modes for versatile functions.

In one aspect, the present invention provides an absorption-desorption-based Carnot battery system. The system comprises a solution repository including at least one solution tank and a refrigerant repository including at least one refrigerant tank, both of which are for thermochemical energy storage; an expander and a compressor for heat-power and power-heat energy conversion respectively; an external vapor-compression heat pump loop between the solution tank and the refrigerant tank; a vapor communication pathway between the solution tank and the refrigerant tank with one or more flow regulating devices positioned within; an internal heat loop between the solution tank and the refrigerant tank; and a controller maintaining the operation mode of the internal heat loop.

In an embodiment, the solution in the solution tank comprises an absorbent selected from salts, ionic liquids or deep eutectic solvents.

In another embodiment, the refrigerant in the refrigerant tank is selected from water, ammonia, hydrofluoroolefin, hydrofluorocarbon, alcohol or carbon dioxide.

In other embodiment, the absorption-desorption-based Carnot battery system has a round-trip efficiency of at least 30.0%.

In yet another embodiment, the absorption-desorption-based Carnot battery system has an energy storage density of at least 7.0 $kWh/m^3$.

In yet other embodiment, the absorption-desorption-based Carnot battery system has a self-discharging rate of lower than 1% after standing for 80 days.

In another aspect of the present invention, a method of operation of the absorption-desorption-based Carnot battery system is also disclosed herein. The operation method is a four-step cycle comprising a charging process, a pre-discharging process, a discharging process and a pre-charging process.

Each of the cycles of the four-step operation cycle corresponds to a specific configuration characterized by the operation mode of the three valves, the internal heat exchange loop and the external cooling and heating loops.

During the charging process, the above-mentioned elements in paragraph are configured such that the first valve and the external cooling and heating loops are opened, and other elements all closed.

During the pre-discharging process, only the internal heat exchange loop is opened, and other elements are all closed.

During the discharging process, the second and third valves and the internal heat exchange loop are opened; the first valve, external cooling and heating loops are closed.

During the pre-charging process, the external cooling loop and the internal heat exchange loop are opened, with other elements closed.

BRIEF DESCRIPTION OF THE DRAWINGS

The patent or application file contains at least one drawing executed in color. Copies of this patent or patent application publication with color drawing(s) will be provided by the office upon request and payment of the necessary fee.

In the following detailed description, reference is made to the accompanying figures, depicting exemplary, non-limiting and non-exhaustive embodiments of the invention. So that the manner in which the above recited features of the present invention can be understood in detail, a more particular description of the invention, briefly summarized above, can be had by reference to the embodiments, some of which are illustrated in the appended figures. It should be noted, however, that the figures illustrate only typical embodiments of this invention and are therefore not to be considered limiting of its scope, for the invention can admit to other equally effective embodiments.

FIG. 2A shows the operation mode under charging process, where the first valve 601 open and the second and third valves 602 and 603 are closed. The external cooling loop 501 and external heating loop 502 stay operational, and the internal heating loop 70 is closed. Under this configuration, a large temperature difference between the solution and the refrigerant tanks causes the refrigerant vapor to be generated in the solution tank, which will pass through first valve 601 and be condensed in the refrigerant tank. Energy storage efficiency/density is enhanced by recapturing a large amount of condensation heat in the refrigerant tank through the heat pump cycle to heat the solution tank after energy upgrading. The continuous generation of refrigerant vapor gradually increases the solution concentration, storing the input renewable electricity in a thermochemical form manifested by a concentration difference.

FIG. 2B shows the operation modes of the elements in the energy storage system under pre-discharging process, which is designed to create a sufficient condition to enable a spontaneous discharging process to be entered into. All valves 601, 602 and 603 are closed, and the external cooling/heating loops (501, 502) are closed, while keeping internal heat exchange loop 70 open. With the internal heat exchange between the solution and liquid refrigerant, the temperature difference between the two tanks decreases to a certain threshold (e,g, 5-10° C.). This procedure, combined with thermal energy recovery, amplifies the refrigerant vapor partial pressure between the two tanks, thereby creating a driving force for the ensuing discharging process.

FIG. 2C shows the operation modes of the elements in the energy storage system during discharging process for power generation, where the stored thermochemical energy, represented by a concentration difference, is converted into usable electrical energy upon demand. This process necessitates first valve 601 to be closed, second and third valves 602, 603 to be opened, external cooling and heating loops 601 and 602 closed, and internal heat exchange loop 70 to be operating. The significant concentration difference between the solution and refrigerant tanks (zero concentration of pure refrigerant) contributes to a notably higher pressure in the solution than in the liquid refrigerant, which instigates the vapor evaporation from the refrigerant tank. The evaporated refrigerant vapor passes through and propels the expander with the enthalpy change converted into electrical energy before being absorbed by the solution. In this stage, the solution/refrigerant tanks function as absorber/evaporator. The absorption process in the solution tank can raise the solution temperature, whereas the evaporation process in the refrigerant tank can reduce the refrigerant temperature, making the discharging process finish quickly because the pressure difference drops at a high rate in this circumstance. To counteract this undesirable effect, the internal heat exchange loop between the solution and refrigerant is implemented to recuperate the absorption heat in the solution tank and subsequently heat the refrigerant tank to foster vapor evaporation, thereby enhancing the discharging depth. The continuous absorption of refrigerant vapor by the solution dilutes the solution, causing a lower concentration and a higher pressure in the solution tank. The discharging process concludes when the pressure difference is no longer sufficient to drive the expander for power generation.

FIG. 2D shows the operation modes of the elements in the energy storage system during pre-charging process, where valves 1-3 are closed, the external cooling loop is open, and the internal heat exchange loop is open. This process aims to restore the system to its original state by cooling the solution/refrigerant tanks, subsequently reducing the pressure difference between the two tanks, and consequently lowering the compression power consumption in the subsequent charging process.

FIG. 2E shows the operation modes of the elements in the energy storage system during discharging process for cooling. This process necessitates the valve 1 to be open, valves 2-3 to be closed, the internal heat exchange loop to be closed, and the external cooling and heating loop to be connected with external fluids. In the cooling mode, the temperature of the external cooling water (through the solution tank) ranges from 25 to 35° C. and the temperature of the external chilled water (through the refrigerant tank) ranges from 2 to 15° C. Due to the high concentration of the solution, the refrigerant vapor is evaporated from the refrigerant tank and absorbed by the concentrated solution. Therefore, the refrigerant tank becomes an evaporator and can produce a cooling effect, while the solution tank becomes an absorber and is cooled by the heat sink to maintain the absorption process. With the refrigerant vapor absorbed, the solution becomes more diluted, and thus the stored thermochemical energy is converted into a cooling effect.

FIG. 2F shows the operation modes of the elements in the energy storage system during discharging process for heating. This process necessitates the valve 1 to be open, valves 2-3 to be closed, the internal heat exchange loop to be closed, and the external cooling and heating loop to be connected with external fluids. For the heating mode, the temperature of the external hot water (through the solution tank) ranges from 40 to 70° C. and the temperature of the external cooling water (through the refrigerant tank) ranges from 20 to 30° C. Because the concentrated solution continuously absorbs the generated refrigerant vapor from the refrigerant tank, the absorption process in the solution tank releases considerable heat to external fluids, and thus converting the thermochemical energy into a heating effect.

FIG. 4A shows the solution/refrigerant temperatures; FIG. 4B shows the mass concentration of the solution; FIG. 4C shows the power input/out and FIG. 4D shows the coefficient of performance (COP) and heat generation efficiency ($\eta_{dis}$) of the ACB system along the four-process cycle.

DETAILED DESCRIPTION

Figure 1:
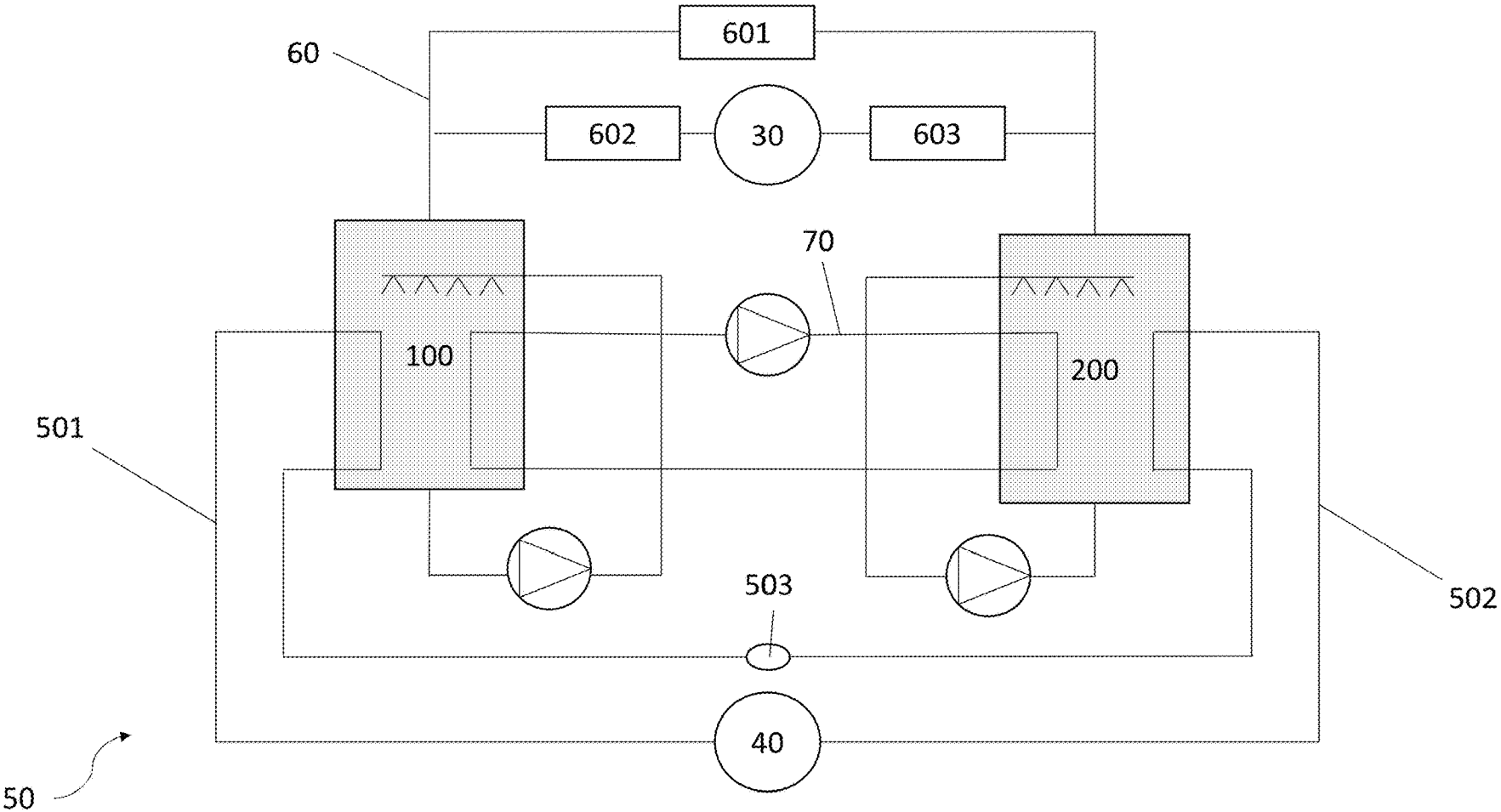
FIG. 1 is a schematic diagram of the absorption-desorption-based Carnot battery system for renewable energy storage. 100 refers to the solution repository including at least one solution tank. 200 refers to the refrigerant repository including at least one refrigerant tank. 30 refers to the expander and 40 refers to the compressor. 50 refers to the entire external heat exchange pump loop, with the left half connecting to the solution tank 100 being the external heating loop (501); and the right half connecting to the refrigerant tank 200 being the external cooling loop (502). 503 refers to an expansion valve. 60 refers to the vapor communication pathway between the solution tank 100 and refrigerant tank 200, the pathway of which is controllable through first valve 601, second valve 602 and third valve 603. 70 refers to the internal heating loop between the solution tank 100 and refrigerant tank 200.
Figure 2A:
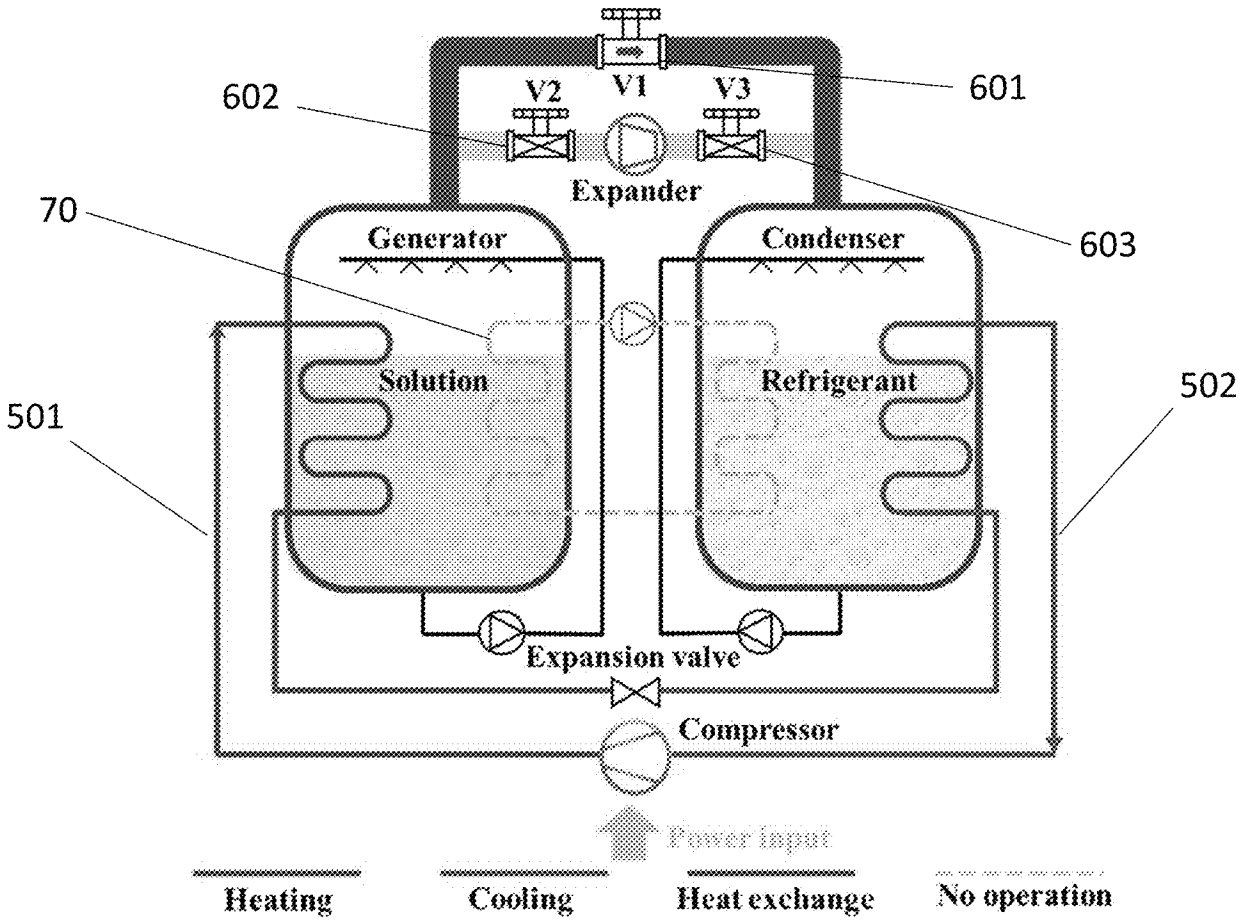
FIGS. 2A to 2F show the different operation modes of the elements in the absorption-desorption-based Carnot battery system for renewable energy storage, under each process of its four-process cycle.
Figure 2B:
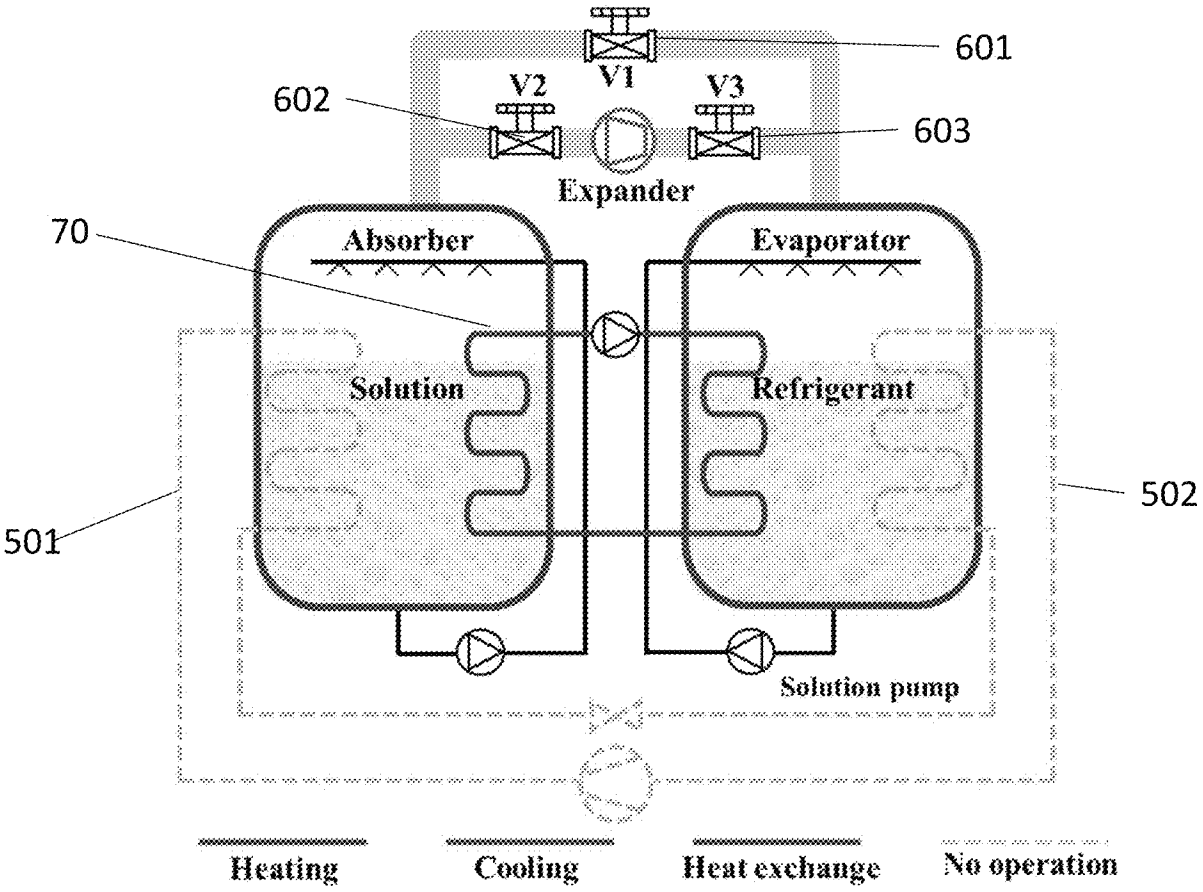
Figure 2C:
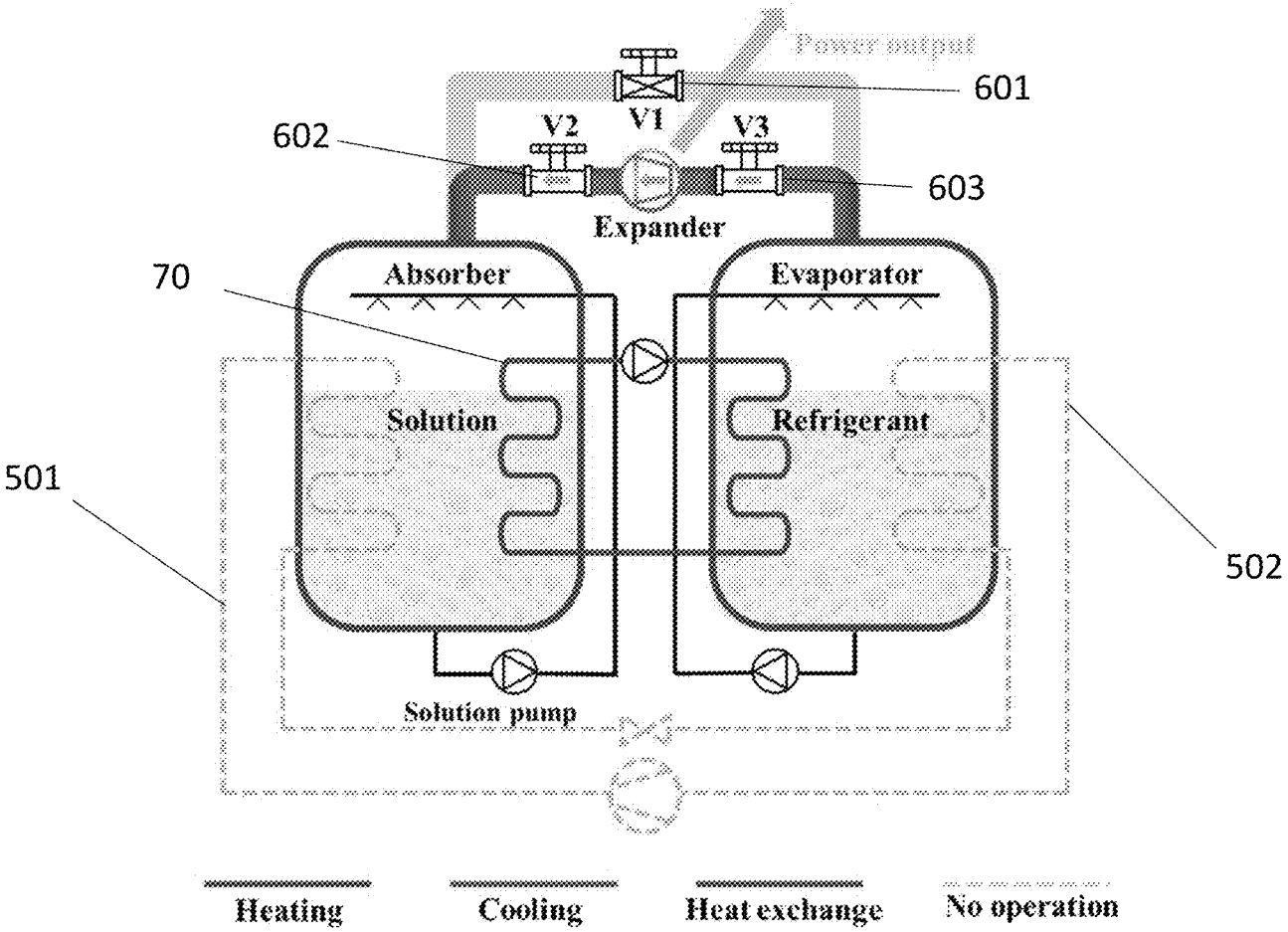
Figure 2D:
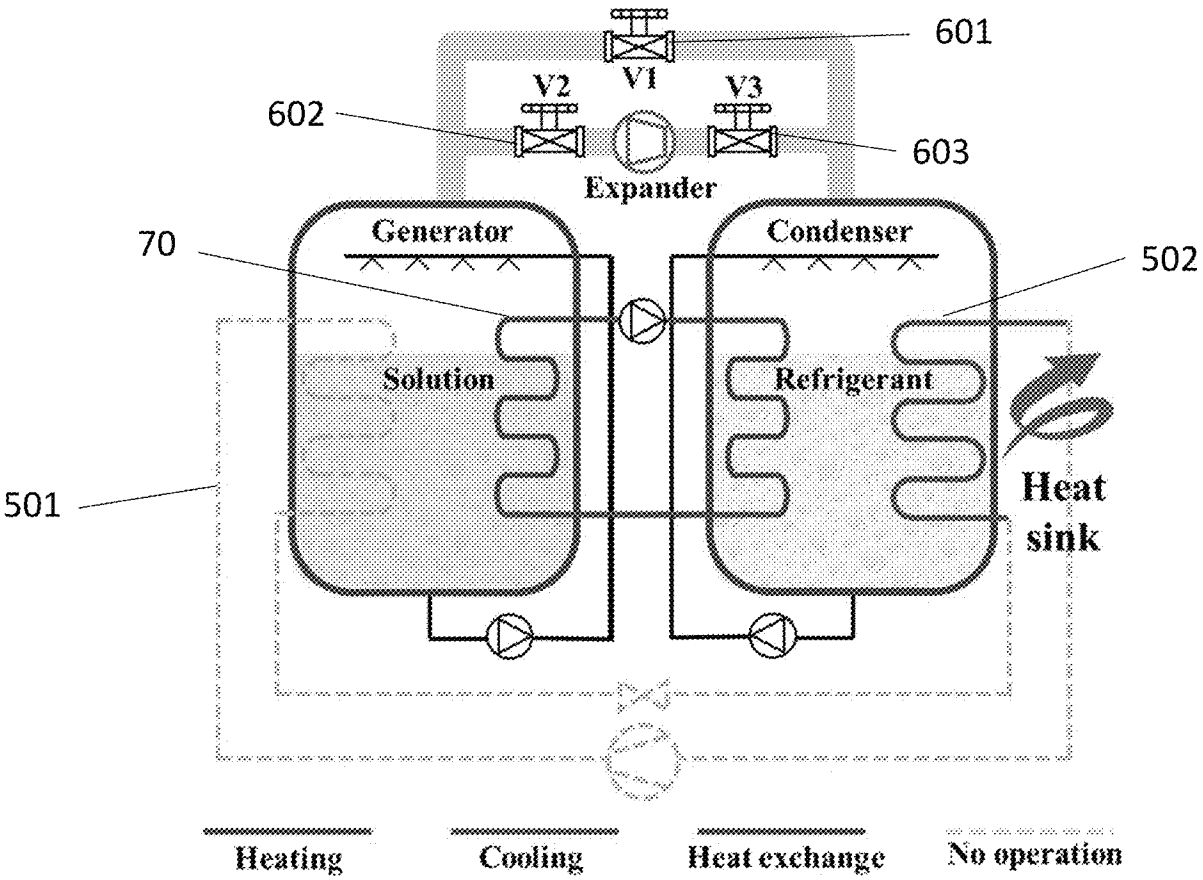
Figure 2E:
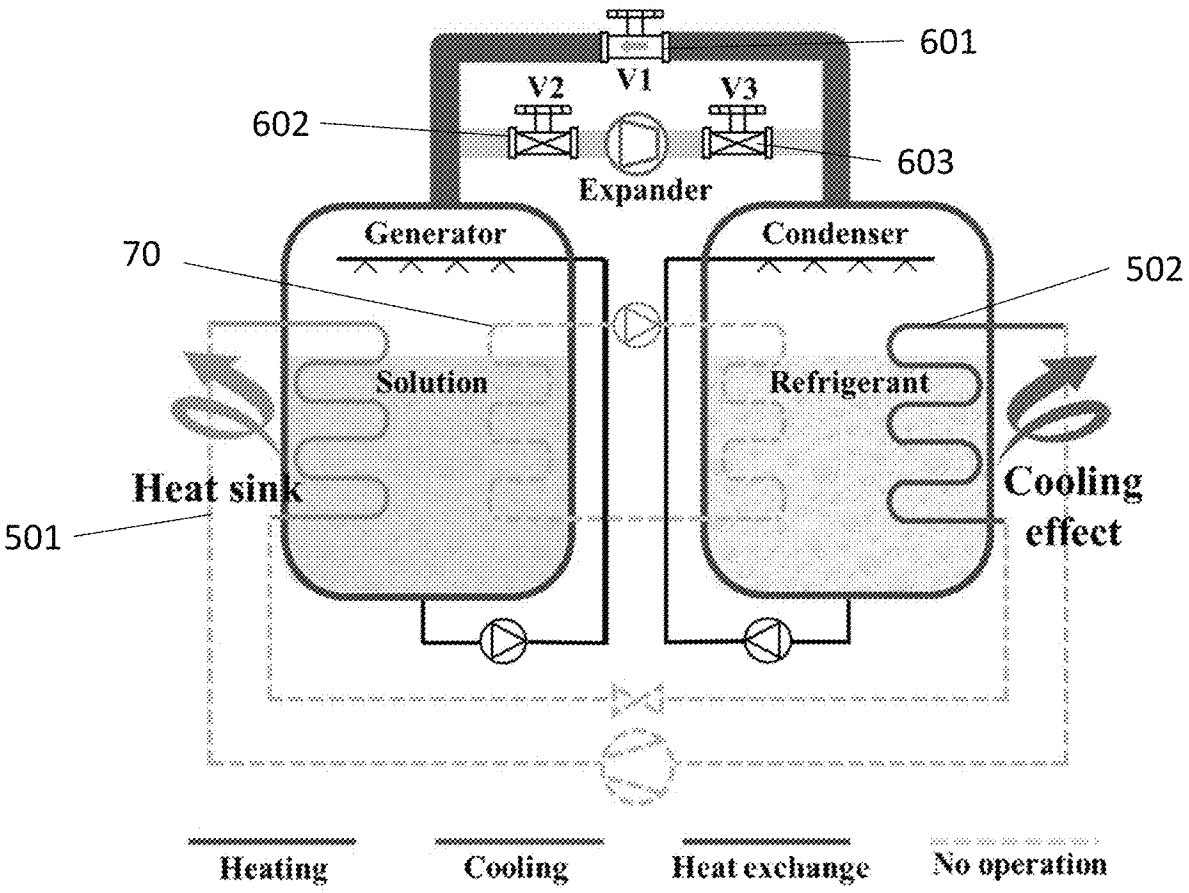
Figure 2F:
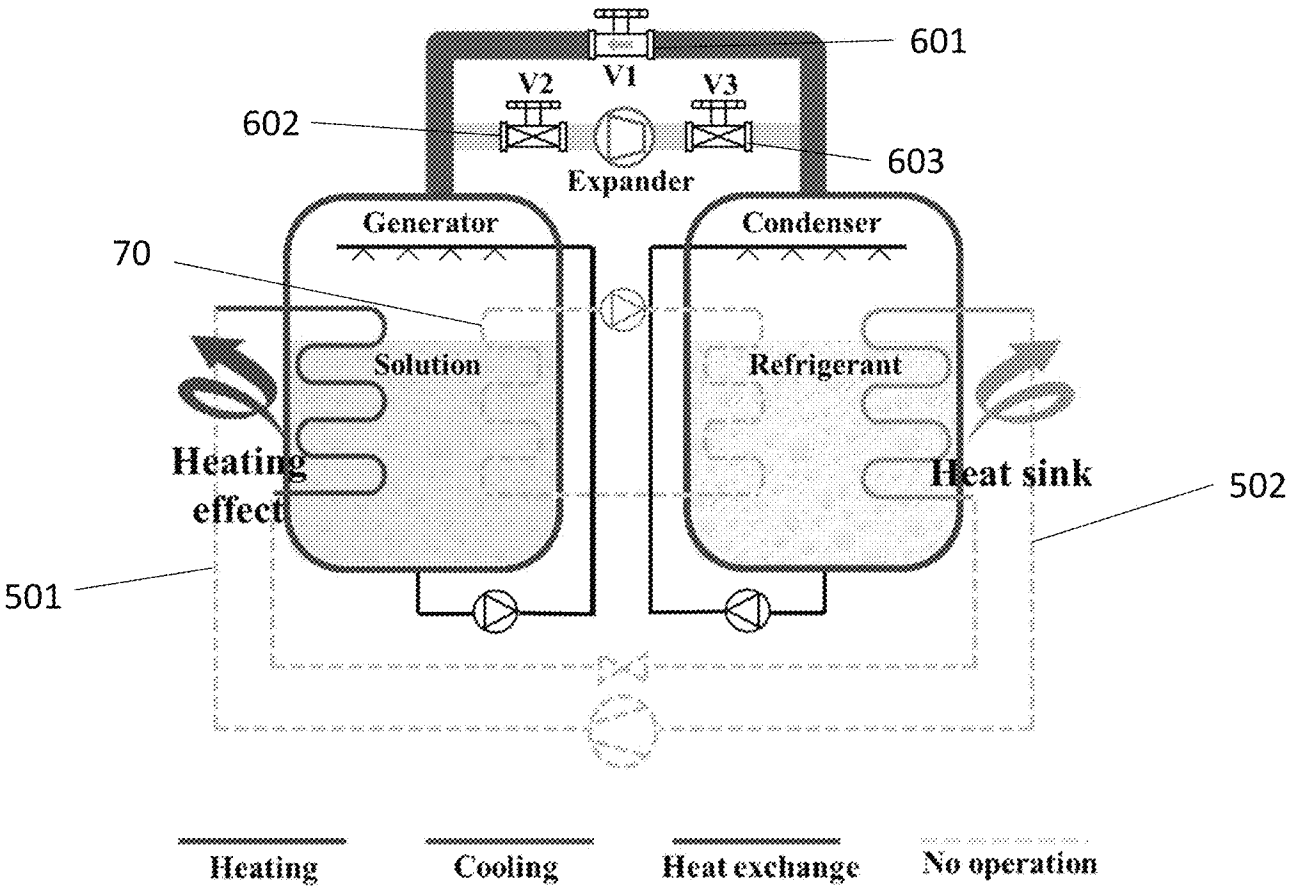

The present invention discloses a absorption-desorption-based Carnot battery system for electrical energy storage, designed to be equipped with a specific set of elements to achieve high efficiency, low loss, good compactness and relatively low cost.

The Carnot battery-based energy storage system comprises a solution a solution repository including at least one solution tank for thermochemical energy storage, the solution being reversibly capable storing and releasing refrigerant. The solution demonstrates hygroscopicity, and the contained absorbent may be selected from a salt (in one embodiment, preferably LiBr); a deep eutectic solvent or an ionic liquid.

The Carnot battery-based energy storage system further comprises a refrigerant repository including at least one refrigerant tank for thermochemical energy storage, wherein the refrigerant may be selected from water, ammonia, hydrofluorocarbon, hydrofluoroolefin or carbon dioxide.

The two-way conversion between heat and power is achieved through the inclusion of an expander, which converts heat to power; and a compressor, which converts power to heat.

An external vapor-compression heat pump loop is also a crucial component of the Carnot battery-based energy storage system, which is positioned between the solution tank and the refrigerant tank. The heat pump loop includes heating and cooling loops and the compressor for receiving surplus electricity from a renewable energy source to generate heat and raise a temperature of the solution during a charging cycle and generating refrigerant vapor in the solution tank.

Further, a vapor communication pathway is placed between the solution tank and the refrigerant tank for receiving refrigerant vapor generated in the solution tank during a charging cycle and passing to the refrigerant tank for condensation in the refrigerant tank to increase the temperature of the refrigerant in the refrigerant tank during the charging cycle, thereby decreasing a concentration of refrigerant in the solution.

One or more flow regulating devices are positioned in the vapor communication pathway, configured to stop the refrigerant vapor flow during a pre-discharging cycle to decrease a temperature difference between the solution tank and the refrigerant tank and increase a refrigerant partial pressure differential between the solution tank and the refrigerant tank.

An internal heat loop is placed between the refrigerant tank and the solution tank, which further includes an expander and receiving vaporized refrigerant from the refrigerant tank and passing it to the solution tank during a discharging cycle such that the expander generates electricity from the passage of the vaporized refrigerant and a pressure in the solution tank increases. A controller is further added to maintain the internal heat exchange pathway open and open the external heating and cooling loop during a pre-charging cycle to cool the refrigerant tank and the solution tank to reduce a pressure differential between the refrigerant tank and the solution tank.

The Carnot battery-based energy storage system with the above setting demonstrates outstanding efficiency under an optimum operation concentration of the solution in the solution tank being 45% to 60%. The system has a round-trip efficiency of at least 30.0%, energy storage density of at least 7.0 kWh/$m^3$ and self-discharging rate of lower than 1% after 80 days of standby.

The Carnot battery-based energy storage system operates in a four-step process, including a charging process, a pre-discharging process, a discharging and a pre-charging process.

In the charging process, excessive renewable electricity is converted into thermochemical energy when the energy supply exceeds demand. This process necessitates first valve (101) to be open, the second and third valves (102, 103) to be closed, external heating/cooling loops to be operational, and the internal heat exchange loop to be closed. An external vapor-compression heat pump loop (comprising external heating/cooling loops, compressor, and expansion valve) utilizes surplus electricity to generate heating effects, thereby raising the temperature of solution. A large temperature difference between the solution and refrigerant tanks causes the refrigerant vapor to be generated in the solution tank, pass through the first valve (101), and be condensed in the refrigerant tank. During this process, the solution/refrigerant tanks function as generator/condenser. Energy storage efficiency/density is enhanced by recapturing a large amount of condensation heat in the refrigerant tank through the heat pump cycle to heat the solution tank after energy upgrading. The continuous generation of refrigerant vapor gradually increases the solution concentration, storing the input renewable electricity in a thermochemical form manifested by a concentration difference.

The pre-discharging process is designed to create a sufficient condition so that the following discharging process can take place spontaneously, with valves 1-3 closed, external heating/cooling loops closed, and internal heat exchange loop open. With the internal heat exchange between the solution and liquid refrigerant, the temperature difference between the two tanks decreases to a certain threshold (e.g. 5-10° C.). This procedure, combined with thermal energy recovery, amplifies the refrigerant partial pressure difference between the two tanks, thereby creating a driving force for the ensuing discharging process.

In the discharging process, the stored thermochemical energy, represented by a concentration difference, is converted into usable electrical energy when energy demand exceeds supply. This process calls for the first valve (101) to be closed, the second and third valves (102, 103) to be opened, external heating/cooling loops to be deactivated, and the internal heat exchange loop to be operated. The significant concentration difference between the solution and refrigerant tanks (zero concentration of pure refrigerant) contributes to a notably higher pressure in the solution than in the liquid refrigerant, which instigates the vapor evaporation from the refrigerant tank. The evaporated refrigerant vapor passes through and propels the expander with the enthalpy change converted into electrical energy, before being absorbed by the solution. In this stage, the solution/refrigerant tanks function as evaporator. The absorption process in the solution tank can raise the solution temperature, whereas the evaporation process in the refrigerant tank can reduce the refrigerant temperature, making the discharging process finish quickly because the pressure difference drops at a high rate in this circumstance. To counteract this undesirable effect, the internal heat exchange loop between the solution and liquid refrigerant is implemented to recuperate the absorption heat in the solution tank and subsequently heat the refrigerant tank to foster vapor evaporation, thereby enhancing the discharging depth. The continuous absorption of refrigerant vapor by the solution dilutes the solution, causing a lower concentration and a higher pressure in the solution tank. The discharging process concludes when the pressure difference is no longer sufficient to drive the expander for power generation.

Finally, the pre-charging process runs with all first to third valves (101, 102, 103) closed, external heating/cooling loops open, and an internal heat exchange loop open. This process aims to restore the system to its original state by cooling the solution/refrigerant tanks, subsequently reducing the pressure difference between the two tanks, and consequently lowering the compression power consumption in the subsequent charging process.

Table 1 below tabulates the operating modes of different elements under different processes.

TABLE 1

| Process | First Valve 101 | Second Valve 102 | Third Valve 103 | Internal heat exchange loop | External cooling loop | External heating loop |
|---|---|---|---|---|---|---|
| Charging | on | off | off | off | on | on |
| Pre-discharging | off | off | off | on | off | off |
| Discharging | off | on | on | on | off | off |
| Pre-discharging | off | off | off | off | off | on |

Figure 3:
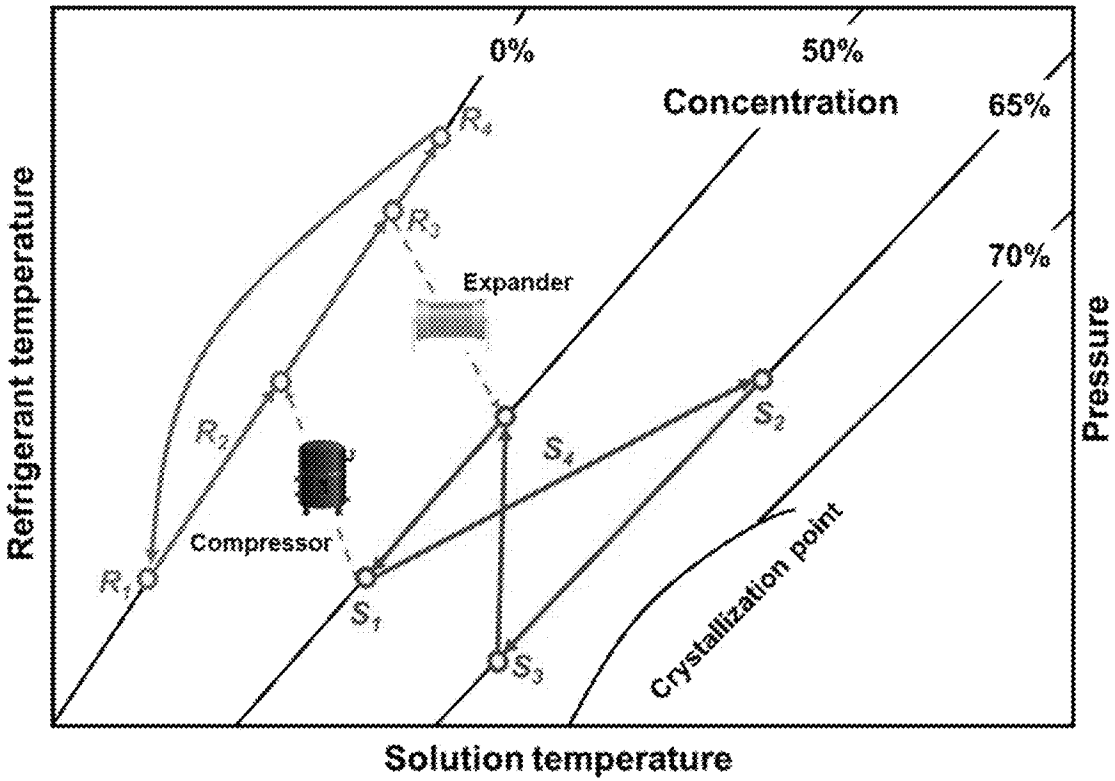
FIG. 3 is plot of PTX diagrams of the ACB cycle using $H_2O$/LiBr.

The working principle of the ACB system employing $H_2O$/LiBr is demonstrated in the PTX (pressure-temperature-concentration) diagram in FIG. 3. The successive progression from charging to pre-discharging, discharging, and finally pre-charging is represented by the transition from point 1 to point 2, point 2 to point 3, point 3 to point 4, and point 4 back to point 1, respectively. The PTX states of the solution and liquid refrigerant are denoted by $S_i$ and $R_i$ correspondingly. During the charging process, the compressor input of renewable electricity causes an increase in both the solution and refrigerant temperatures, accompanied by a rise in the solution concentration as vapor refrigerant is generated from the solution tank. The pre-discharging process brings about a decrease in the solution temperature and an increase in the refrigerant temperature, attributable to the internal heat exchange between the two tanks. The discharging process sees a minor increase in both the solution and refrigerant temperatures because the dilution process of LiBr solution releases heat. Because there is no heat transfer between the entire ACB system and the environment, the released heat in the dilution process will lead to small increases in the solution/refrigerant temperatures. The pre-discharging process results in a temperature drop for both solution and refrigerant and restores them to the initial state of the charging process through the cooling effect of the external heat sink.

EXAMPLES

Example 1—Methodology 1.1 Mathematical Models

Several commonly used assumptions have been employed to develop the mathematical model of the ACB system: (i) uniformity of temperatures, pressures, and concentrations in both solution and refrigerant tanks, and (ii) disregarding pressure drops and heat losses. Utilizing these simplifications, along with mass and energy balance equations, the dynamic model of the ACB system has been formulated.

The mass balance of storage tanks is governed by the below equations, where Ms and $M_r$ are the solution masses and liquid refrigerant mass respectively; $\dot{m}_{s,in}$ and $\dot{m}_{s,out}$ are the inlet and outlet vapor mass flow rates of the solution tank respectively; $\dot{m}_{r,in}$ and $\dot{m}_{r,out}$ are the inlet and outlet vapor mass flow rates of the refrigerant tank respectively; x denotes the absorbent concentration of the solution:

$$\frac{dM_s(\tau)}{d\tau} = \dot{m}_{s,in}(\tau) - \dot{m}_{s,out}(\tau) \tag{1}$$

$$\frac{dM_r(\tau)}{d\tau} = \dot{m}_{r,in}(\tau) - \dot{m}_{r,out}(\tau) \tag{2}$$

$$\frac{d[M_s(\tau)x(\tau)]}{d\tau} = 0 \tag{3}$$

The energy balance of storage tanks is expressed by the equations below, where $h_s$ and $h_r$ are the specific enthalpies of the solution and liquid refrigerant; $\dot{Q}_{s,in}$ and $\dot{Q}_{s,out}$ are the inlet and outlet heat duties of the solution tank respectively; $\dot{Q}_{r,in}$ and $\dot{Q}_{r,out}$ are the inlet and outlet heat duties of the refrigerant tank respectively; U and A denote the overall heat transfer coefficient and heat exchanger surface respectively. ΔT is the temperature difference between the internal and external working fluids:

$$\frac{d[M_s(\tau)h_s(\tau)]}{d\tau} = \dot{Q}_{s,in}(\tau) - \dot{Q}_{s,out}(\tau) \tag{4}$$

$$\frac{d[M_r(\tau)h_r(\tau)]}{d\tau} = \dot{Q}_{r,in}(\tau) - \dot{Q}_{r,out}(\tau) \tag{5}$$

$$\dot{Q}(\tau) = UA \cdot \Delta T(\tau) \tag{6}$$

The governing equations of the compressor are as below, where $\dot{W}_{comp}$ refers to the power consumed by the compressor; $\dot{m}_{v,com}$ is the vapor mass flow rate through the compressor; $h_{out,ide}$ refers to the ideal refrigerant enthalpy at the outlet; $\eta_{i,comp}$, $\eta_{mo,comp}$ and $\eta_{me,comp}$ are the isentropic efficiency, mechanical efficiency and motor efficiency respectively; $P_{in}$ and $P_{out}$ denote the inlet and outlet pressures of the compressor respectively:

$$\dot{W}_{comp}(\tau) = \frac{\dot{m}_{v,comp}(\tau) \cdot (h_{out,ide}(\tau) - h_{in}(\tau))}{\eta_{is,comp}(\tau) \cdot \eta_{mo,comp}\eta_{me,comp}} \tag{7}$$

$$\eta_{is,comp}(\tau) = 1.0094 - 0.0504\frac{P_{in}(\tau)}{P_{out}} \tag{8}$$

The governing equations of the expander are as below, where $\dot{W}_{ex}$ refers to the power generated by the expander; $\dot{m}_{v,ex}$ is the vapor mass flow rate through the expander; $\dot{m}_{v,N}$, $\dot{P}_{in,N}$ and $\overline{P}_{out,N}$ are the nominal vapor mass flow, nominal inlet pressure and nominal outlet pressure; $\eta_{mo,ex}$ and $\eta_{me,ex}$ are the motor efficiency and mechanical efficiency of the expander respectively; $\eta_{is,ex}$ is the isentropic efficiency of the expander:

$$\frac{\dot{m}_v^2(\tau)}{\dot{m}_{v,n}^2} = \frac{P_{in}^2(\tau) - P_{out}^2(\tau)}{P_{in,N}^2 - P_{out,N}^2} \tag{9}$$

$$\dot{W}_{ex}(\tau) = \dot{m}_v(\tau) \cdot (h_{out,ide}(\tau) - h_{in}(\tau))\eta_{is,ex}(\tau) \cdot \eta_{mo,ex} \cdot \eta_{me,ex} \tag{10}$$

The isentropic efficiency of the expander, $\eta_{is,ex}$, is further calculated by the below, where $\overline{v}_{wf}$ is the volumetric flow rate of the working fluid; $z_{exp}$ is the ratio of the specific volume at the expander outlet to that at the expander inlet; $z_{exp}'$ is the off-design $z_{exp}$ of the expander; c is a correction factor used for sizing the screw expander and c* is a post-expansion correction factor which captures the efficiency reduction of the screw expander to off-design operation effects:

$$\begin{cases} \eta_{is,ex} = c[0.9403305 + 0.0293295\ln(\dot{v}_{wf}) - 0.0266398z_{exp}]c^* \\ c = 1, \text{ if } z_{exp} \le 7 \\ c = 1 - 0.264\ln\left(\frac{z_{exp}}{7}\right), \text{ if } z_{exp} \le 7 \\ c^* = -0.03229\left(\frac{z'_{exp}}{z_{exp}}\right)^4 + 0.288\left(\frac{z'_{exp}}{z_{exp}}\right)^4 - 0.8995\left(\frac{z'_{exp}}{z_{exp}}\right)^4 \\ \quad +1.0064\left(\frac{z'_{exp}}{z_{exp}}\right)^4 + 0.60558 \end{cases} \tag{11}$$

For sensible thermal energy storage, a cylindrical tank with a certain height ($H_{tank}$) and radius ($r_{tank}$) is used to store the medium for energy storage. The glass wool with a certain thickness ($\theta_{tank}$) is selected as the insulation material of the tanks. The heat losses of the tanks are calculated by below, where $U_{sur}$ and $U_{gnd}$ are the heat transfer coefficients of the tank surface in contact with air and ground, respectively; T medium and $T_{amb}$ are the medium temperature and ambient temperature, respectively; $k_{gw}$ and $\theta_{gw}$ are the thermal conductivity and thickness of the insulation material (glass wool), respectively; $hc_{sur}$ is the convective heat transfer coefficient of the insulation material; $K_{gnd}$ is the thermal conductivity of the ground:

$$\dot{Q}_{loss} = (U_{sur}A_{sur} + U_{gnd}A_{gnd}) \cdot (T_{medium} - T_{amb}) \tag{12}$$

$$U_{sur} = \frac{1}{\left(\frac{\theta_{gw}}{k_{gw}} + \frac{1}{hc_{sur}}\right)} \tag{13}$$

$$U_{gnd} = \frac{1}{\left(\frac{\theta_{gw}}{k_{gw}} + \frac{4}{3\pi k_{gnd}}\right)} \tag{14}$$

The vapor pressure, special enthalpy, density and heat capacity of the LiBr solution are governed by the equations below, where $P_s$, $h_s$, ρs, and $C_{p,s}$ denote the vapor pressure, special enthalpy, density, and heat capacity of the LiBr solution; $T_s$ and x are the temperature and concentration of the solution:

$$\begin{cases} A_p = \sum_{i=0}^{3} a_{i,p}(x \times 100)^i; \\ B_p = \sum_{i=0}^{3} b_{i,p}(x \times 100)^i + 273.15; \\ C_p = 7.05,\ D_p = -1596.49,\ E_p = -104095.5 \\ LnP_s = \sum_{i=0}^{2} \frac{c_{i,p}}{(T_s - B_p)/A_p^2} \end{cases} \quad (15)$$

$$\begin{cases} A_{ent} = \sum_{i=0}^{4} a_{i,ent}(x \times 100)^i; \\ B_{ent} = \sum_{i=0}^{3} b_{i,ent}(x \times 100)^i; \\ C_{ent} = \sum_{i=0}^{4} c_{i,ent}(x \times 100)^i; \\ h_s = A_{ent} + B_{ent} \times (T_s - 273.15) + C_{ent} \times (T_s - 273.15)^2 \end{cases} \quad (16)$$

$$\rho_s = \sum_{i=0}^{2} a_{i,dens}(x \times 100)^i - (b_{0,dens} + b_{1,dens} x \times 100)T_g \quad (17)$$

$$C_{p,s} = \sum_{i=0}^{2} a_{i,cp}(x \times 100)^i \quad (18)$$

The fitting parameters in the property equations are listed in Table 2 below:

TABLE 2

| Parameter | i = 0 | i = 1 | i = 2 | i = 3 | i = 4 |
|---|---|---|---|---|---|
| $a_{i,p}$ | −2.00755 | 0.16976 | −0.003133 | 0.00001977 | / |
| $b_{i,p}$ | 124.937 | −7.71649 | 0.152286 | −0.0007959 | / |
| $c_{i,p}$ | 7.05000 | −1596.49 | −104095.5 | / | / |
| $a_{i,ent}$ | −2024.33 | 163.309 | −4.88161 | 0.06302948 | −0.00029137 |
| $b_{i,ent}$ | 18.2829 | −1.1691757 | 0.03248 | −0.00040341 | 0.00000185 |
| $c_{i,ent}$ | −0.0037008 | 0.0028878 | −0.000081 | 0.00000099 | −0.0000000044 |
| $a_{i,dens}$ | 1145.36 | 470.84 | 1374.79 | / | / |
| $b_{i,dens}$ | 0.333393 | 0.571749 | / | / | / |
| $a_{i,cp}$ | 3825.4 | −37.512 | 0.0976 | / | / |

1.2 Parameters Setting and Evaluation

Table 3 presents the parameter settings employed in the ACB system simulation. The concentration under investigation spans from 0.35 to 0.65. When the initial charging concentration ($x_{charg}$) is less than 0.35, the ensuing weak absorption process diminishes energy efficiency during the discharging process, thereby making the energy storage ineffective. Conversely, if the initial discharging concentration ($x_{dis}$) exceeds 0.65, the ACB cycle faces a significant risk of crystallization, compromising system stability. The initial solution mass in the charging process is set to 200,000 kg to design an energy storage system boasting an energy capacity of 2.25 MWh. The heat transfer areas are judiciously determined, taking into account the storage tank size. In this study, all the mathematical models of dynamic processes and the corresponding parameters are solved using Modelica 3.2.2.

TABLE 3

| Symbol | Meaning | Typical value (value range) |
|---|---|---|
| $x_{weak}$ | Concentration of weak solution (initial charging concentration) | 0.45 (0.35-0.625) |
| $x_{str}$ | Concentration of strong solution | 0.60 (0.40- |

TABLE 3-continued

| Symbol | Meaning | Typical value (value range) |
|---|---|---|
| | (initial discharging concentration) | 0.65) |
| $M_{s,charg}$ | Initial solution mass of charging process | 200000 kg |
| $r_{tank}$ | Radius of the storage tank | 5.5 m |
| $H_{tank}$ | Height of the storage tank | 2.5 m |
| $\theta_{tank}$ | Thickness of insulation material | 0.5 m |
| $A_s$ | Heat transfer area of the solution tank | 41.5 $m^2$ |
| $A_r$ | Heat transfer area of the refrigerant tank | 41.5 $m^2$ |
| $A_{inter}$ | Heat transfer area of the internal loop | 80 $m^2$ |
| $T_{amb}$ | Ambient temperature | 25 (20-35) ° C. |
| $\dot{m}_{v,N}$ | Nominal vapor mass flow | 10 kg/s |
| $\dot{P}_{in,N}$ | Nominal inlet pressure of the expander | 1430 kPa |
| $\dot{P}_{out,N}$ | Nominal outlet pressure of the expander | 190 kPa |
| $\eta_{mo}$ | Motor efficiency | 0.98 |
| $\eta_{me}$ | Mechanical efficiency | 0.98 |
| $\eta_{pump}$ | Pump efficiency | 0.8 |

The RTE is one of the most important performance indicators for evaluating the energy storage system, which reflects the energy conversion efficiency of the whole process and is calculated by below, where $COP_{charg}$ is the coefficient of performance of the proposed system in the charging process; $\eta_{dis}$ is the power generation efficiency in the discharging process; $SDR_{sto}$ refers to the self-discharging rate in the standby process:

$$RTE = COP_{charg} \cdot \eta_{dis} \cdot (1 - SDR_{sto}) \quad (19)$$

The three indicators are defined by the equations below, where $\dot{Q}_{out,charg}$ and $\dot{W}_{in,charg}$ are the heat output and power input in the charging process, respectively; $\dot{Q}_{in,dis}$ and $\dot{W}_{out,dis}$ are the heat input and power output in the discharging process, respectively; $\dot{Q}_{loss}$ refers to the heat loss in the standby stage:

$$COP_{charg} = \frac{\dot{Q}_{out,charg}}{\dot{W}_{in,charg}} \quad (20)$$

$$\eta_{dis} = \frac{\dot{W}_{out,dis}}{\dot{Q}_{in,dis}} \quad (21)$$

$$SDR_{sto} = \frac{\dot{Q}_{loss}}{\dot{Q}_{out,charg}} \quad (22)$$

The ESD is an essential performance indicator reflecting the system compactness, as defined below where $\dot{E}_{out,dis}$ is the electrical energy output of the energy storage system in a whole cycle; $V_{sto}$ is the volume of tanks containing the energy storage media. For the ACB system, $V_{sto}$ is the summed volume of the solution and refrigerant tanks:

$$ESD = \frac{\dot{E}_{out,dis}}{V_{sto}} \tag{23}$$

The power storage density (PSD), another an important indicator reflecting the system compactness, is defined by the equation below, where $\dot{W}_{out,ave}$ is the average power output of the energy storage system in a whole cycle:

$$PSD = \frac{\dot{W}_{out,ave}}{V_{sto}} \tag{24}$$

1.3 Economic Evaluation Method

In addition to the performance indicators including RTE, ESD, and PSD, the economic index is also an important indicator for evaluating the practical application potential of energy storage systems. Hence, the widely used levelized cost of storage (LCOS) is applied to compare the economic performance of different energy storage systems, which is calculated by the below, where $C_{ini}$, $C_{envri}$, $\dot{C}_{mt}$ and $\dot{C}_{ope}$ denote the initial cost, environmental cost, maintenance cost, and operating cost, respectively; d denotes the discount rate (5% in this work); LT refers to the storage system lifetime (30 years in this work):

$$LCOS\left(\frac{\$}{\text{kWh}}\right) = \frac{C_{ini} + C_{envri} + \sum_{i=1}^{LT} \frac{\dot{C}_{mt} + \dot{C}_{ope}}{(1+d)^2}}{\sum_{i=1}^{LT} \frac{\dot{P}_{out}}{(1+d)^2}} \tag{25}$$

The initial cost ($C_{ini}$) is the summed cost of the compressor, expander, generator, pump, heat exchanger, storage tank, and working fluid. For the maintenance cost ($\dot{C}_{mt}$), it is assumed as 2.5% of the initial cost per year. The economic models of the considered equipment are listed in Table 4.

TABLE 4

| Component | Economic model |
|---|---|
| Expander | $C_{ex} = 10^{\left(2.7051+1.4398 log_{10}\dot{W}_{ex} - 0.1776(log_{10}\dot{W}_{ex})^2\right)}$ |
| Compressor | $C_{comp} = 98400 \times \left(\frac{\dot{W}_{comp}}{250}\right)^{0.46}$ |
| Motor | $C_{motor} = 2 \times 10^5 \times \left(\frac{\dot{W}_{motor}}{500}\right)^{0.67}$ |
| Pump | $C_{pump} = 9840 \times \left(\frac{\dot{W}_{pump}}{4}\right)^{0.55}$ |
| Heat exchanger | $\log_{10}C_{hx} = 4.3247 - 0.3030\log_{10}A_{hx} + 0.1634(\log_{10}A_{hx})^2$ |
| Storage tank | $C_{tank} = 50990 + 37.04V_{sto} - 0.0003V_{sto}^2$ |
| Working fluid | $C_{wf} = 7.01 \times m_{wf} \times x_{wf}$ |

Herein, it is supposed that the studied energy storage system completes a whole cycle in a day, and it works for 300 days per year. Hence, the storage tank volume $V_{sto}$, heat transfer area $A_{hx}$, working fluid mass $m_{ws}$, absorbent concentration $x_{ws}$, compressor power $\dot{W}_{comp}$, expander power $\dot{W}_{ex}$, motor power $\dot{W}_{motor}$ and pump power $\dot{W}_{pump}$ can be obtained based on the established cycle models.

The operating cost $\dot{C}_{ope}$ of an energy storage system is calculated as below, where $\dot{W}_{in}$ and $pri_{in}$ refer to the power input and the electricity price, respectively; $\dot{W}_{out}$ and $pri_{out}$ refer to the power output and the corresponding price, respectively:

$$\dot{C}_{ope} = \dot{W}_{in}pri_{in} - \dot{W}_{out}pri_{out} \tag{26}$$

For rational electricity storage and usage, the day can be segmented into peak, off-peak, and flat periods by the electrical load. The peak period, encompassing the hours from 11:00-13:00 and 17:00-23:00, has an electricity price of 0.105 \$/kWh. The off-peak period, which spans from 0:00-7:00 and 23:00-24:00, offers an electricity price of 0.0336 \$/kWh. Lastly, the flat period, covering 7:00-11:00 and 13:00-17:00, carries an electricity price of 0.0504 \$/kWh. For optimal economic performance, the energy storage system should store electricity during the off-peak or flat periods and discharge during the peak period to minimize operating costs. When the RTE surpasses a certain threshold, and the revenue from discharged power outstrips the cost of charging, the energy storage system can yield profit.

As for environmental costs, the life cycle climate performance method is employed to estimate total emissions over the system lifetime, which can be categorized into direct and indirect emissions. The amounts of direct and indirect emissions are computed b below, where $M_r$ denotes the refrigerant charge; ALR represents an annual leakage rate (% of $M_r$); EOL stands for refrigerant leakage at the end of life (% of $M_r$); GWP is global warming potential; $GWP_{adp}$ refers to GWP of the atmospheric degradation product of the refrigerant; AEC signifies the annual energy consumption, and EF is the emission factor, which is calculated based on the resource shares of power plants; the equivalent $CO_2$ emission from manufacturing 1 kg of a given material is expressed as MM; $M_{manu}$ refers to the mass of the material; the equivalent $CO_2$ emission from recycling 1 kg of material is symbolized by RM, with $M_{recycle}$ indicating the mass of recycled material; RFM and RFD correspond to refrigerant manufacturing emissions and refrigerant disposal emissions, respectively; an $p_{dam}$ represents the environmental cost per unit of $CO_2$ emission, set to 5.35 \$/ton:

$$\begin{cases} Em_{direct} = M_r \times (LT \times ALR + EOL) \times (GWP + GWP_{adp}) \\ Em_{indirect} = Em_{energy} + Em_{eq.mfg} + Em_{eq.rcy} + Em_{re,mfg} \\ Em_{energy} = \sum_{i=1}^{LT} \frac{\dot{W}_{out} \times EF}{(1+d)^2} \\ Em_{eq.mfg} = \sum (MM \times M_{manu}) \\ Em_{eq.rcy} = \sum (RM \times M_{recycle}) \\ Em_{re.mfg} = (M_r + M_r \times ALR \times LT) \times RMF + M_r \times (1 - EOL) \times RFD \\ \dot{C}_{en}(Em_{direct} + Em_{indirect}) \cdot p_{dam} \end{cases} \tag{27}$$

Example 2—Discussions 2.1 Dynamic Characteristics of the ACB Cycle

FIG. 4 depicts the dynamic performance of the ACB cycle using $H_2O$/LiBr investigated in a specific case (as specified in Table 3). The solution/refrigerant temperatures in the four processes of the ACB cycle are indicated in FIG. 4A. In the discharging process, both the solution and refrigerant temperatures rise slightly. In the early stage of the discharging process, the heat of dilution is released concurrently with the decrease in solution concentration. Given that the whole system is considered isolated, this increase in sensible heat, caused by the dilution effect, induces an increase in the temperatures of both the solution and the refrigerant tanks. During the charging process, the temperatures of the solution and refrigerant consistently rise due to the compressor power input. Notably, the solution temperature rises more than the refrigerant temperature, owing to the increasing solution concentration. The dynamic mass concentration of the solution throughout the charging and discharging processes is illustrated in FIG. 4B. During the charging process, the mass concentration rises from 45% to 60%, a process that takes approximately 12.3 hours. Conversely, during the discharging process, it ascends from 60% to 45%, which takes around 5.1 hours.

Figure 4A:
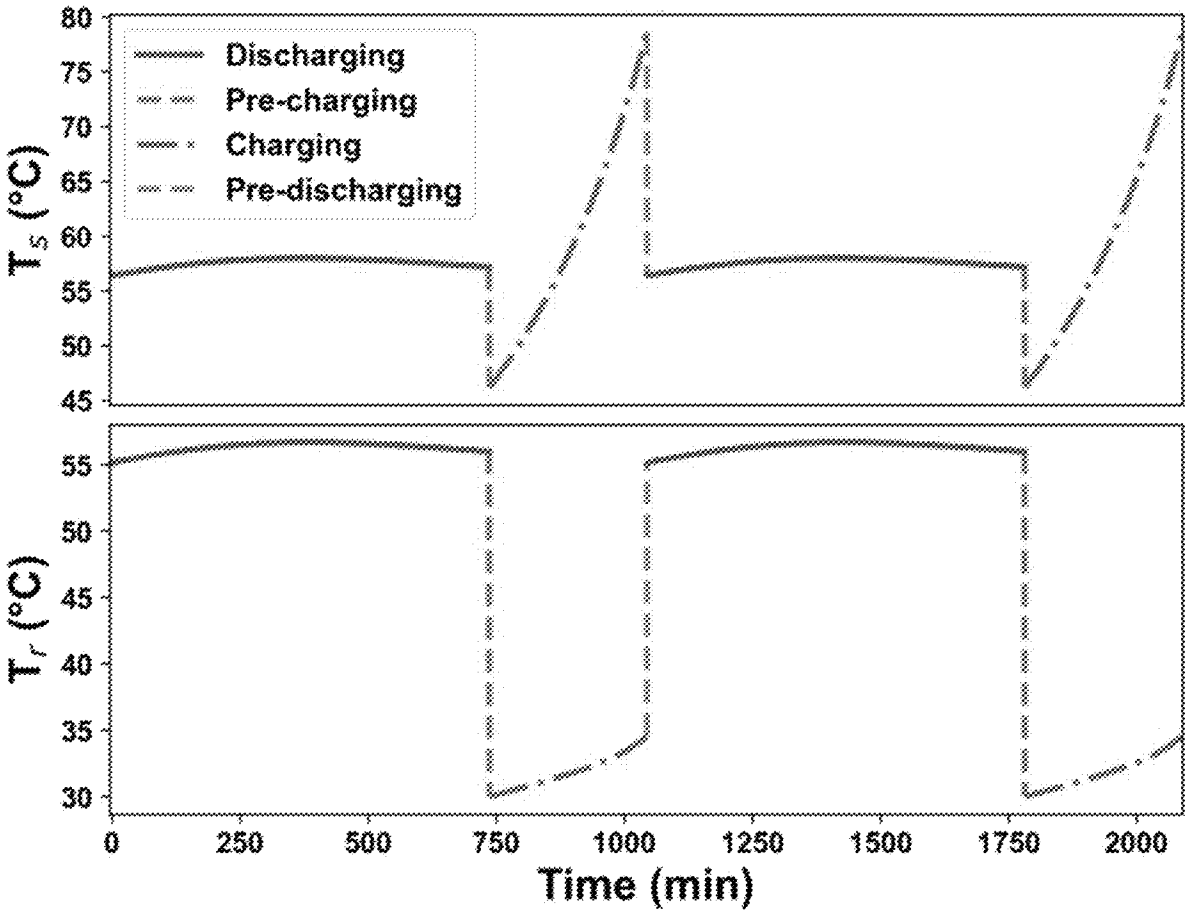
FIGS. 4A to 4D illustrates the respective dynamic characteristics of the ACB system.
Figure 4B:
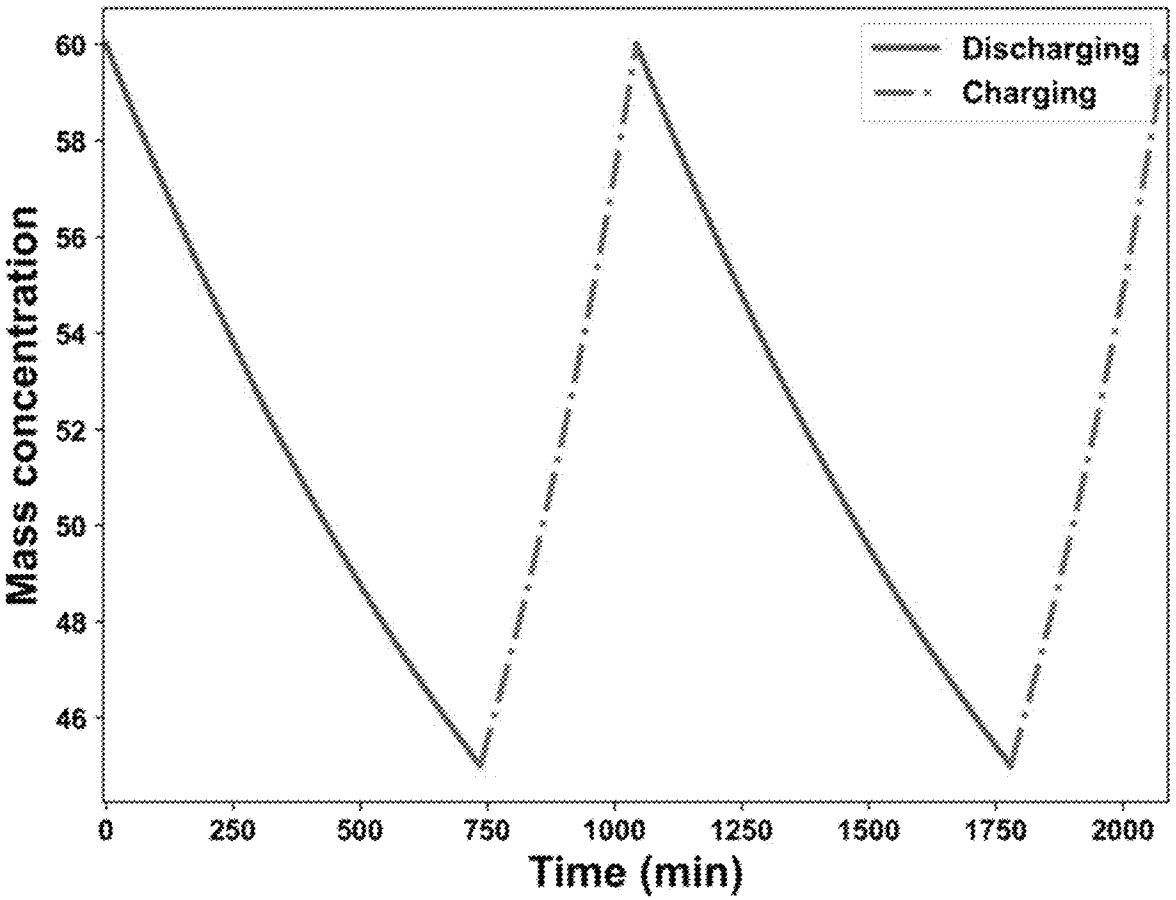
Figure 4C:
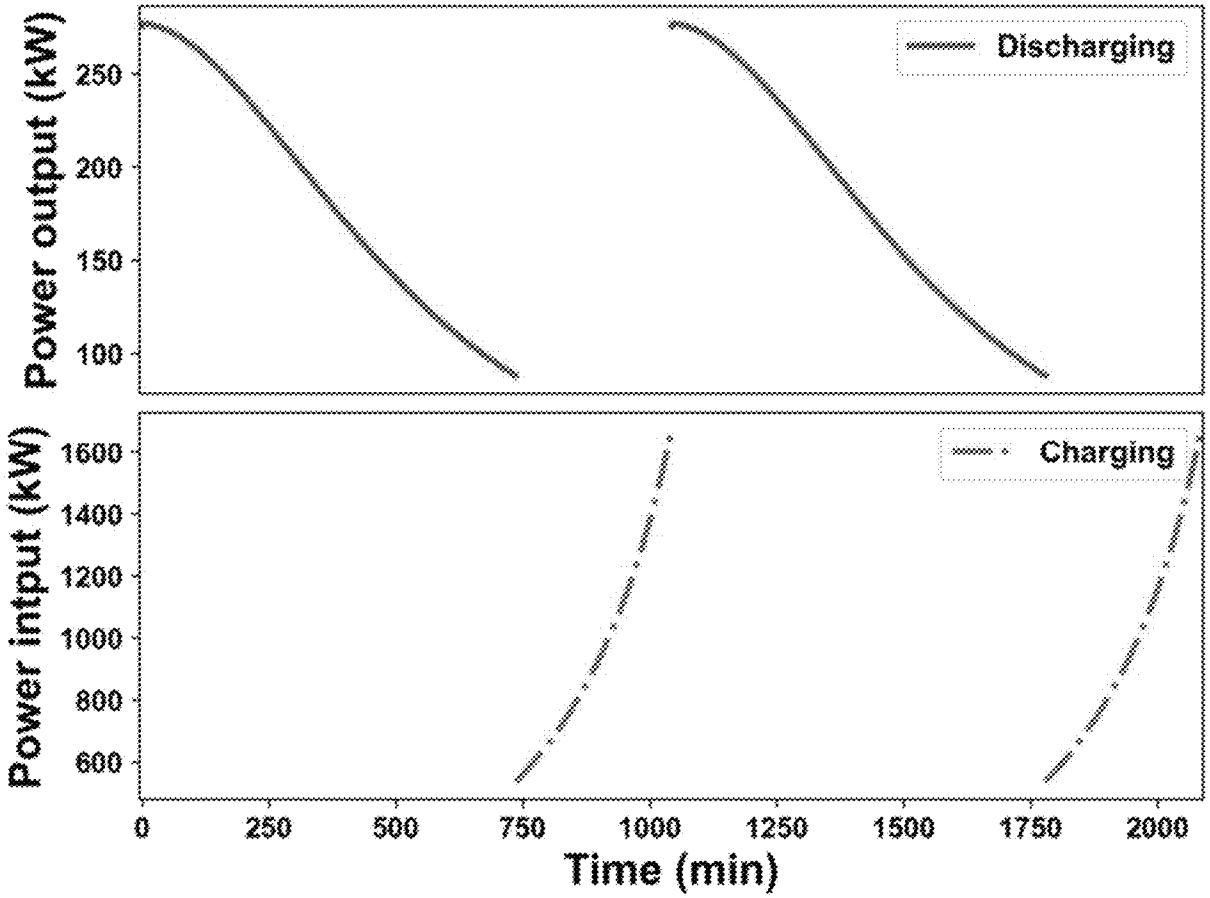
Figure 4D:
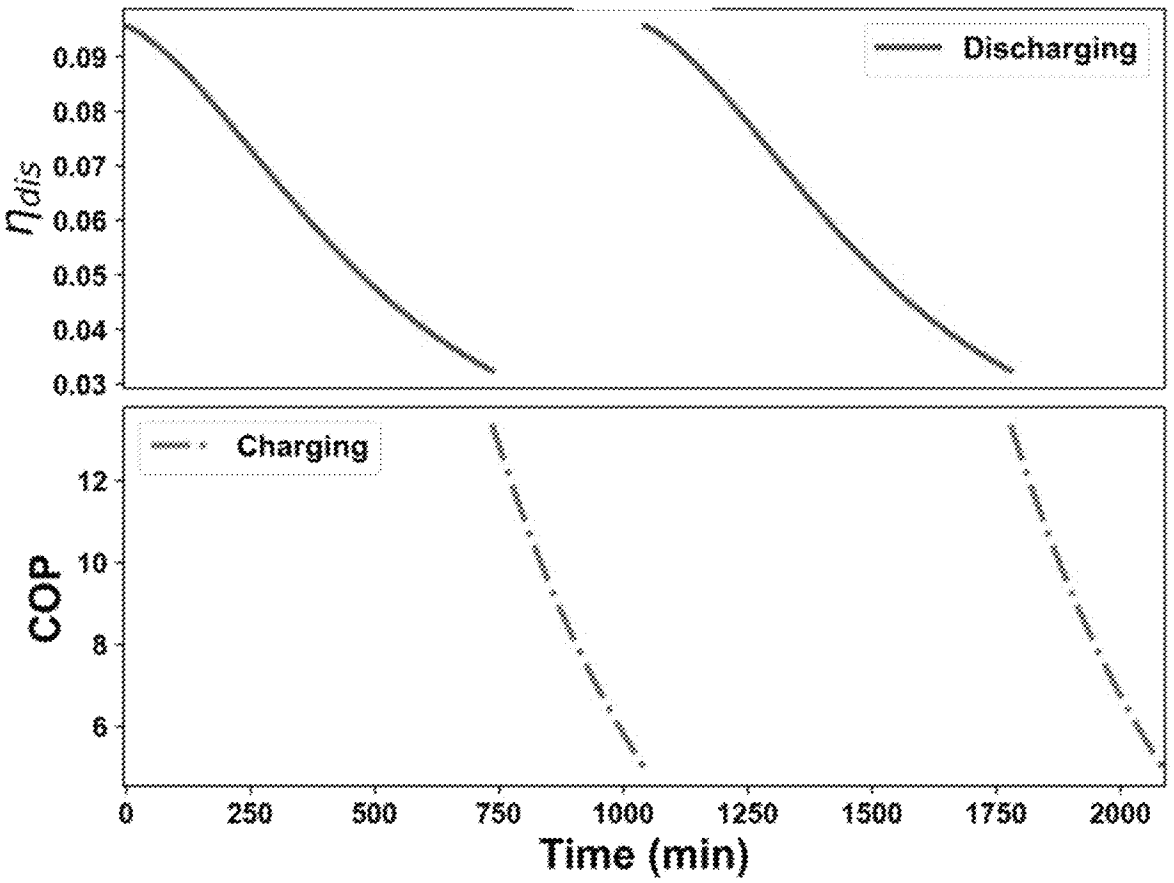

FIG. 4C dynamically showcases the power input during the charging process and power output during the discharging process. As the solution concentration increases, it becomes more challenging to generate vapor refrigerant from the solution tank, thereby necessitating a higher power input in the charging process. A progressive decrease in power output occurs over time, primarily due to a reducing concentration difference between the two tanks, which will be explained in FIGS. 5A and 5B in details. As described in FIG. 4D, the power generation efficiency ($\eta_{dis}$) steadily declines during the discharging process because of diminishing power output. Concurrently, the COP also continually drops during the charging process due to the escalating power input.

Figure 5A:
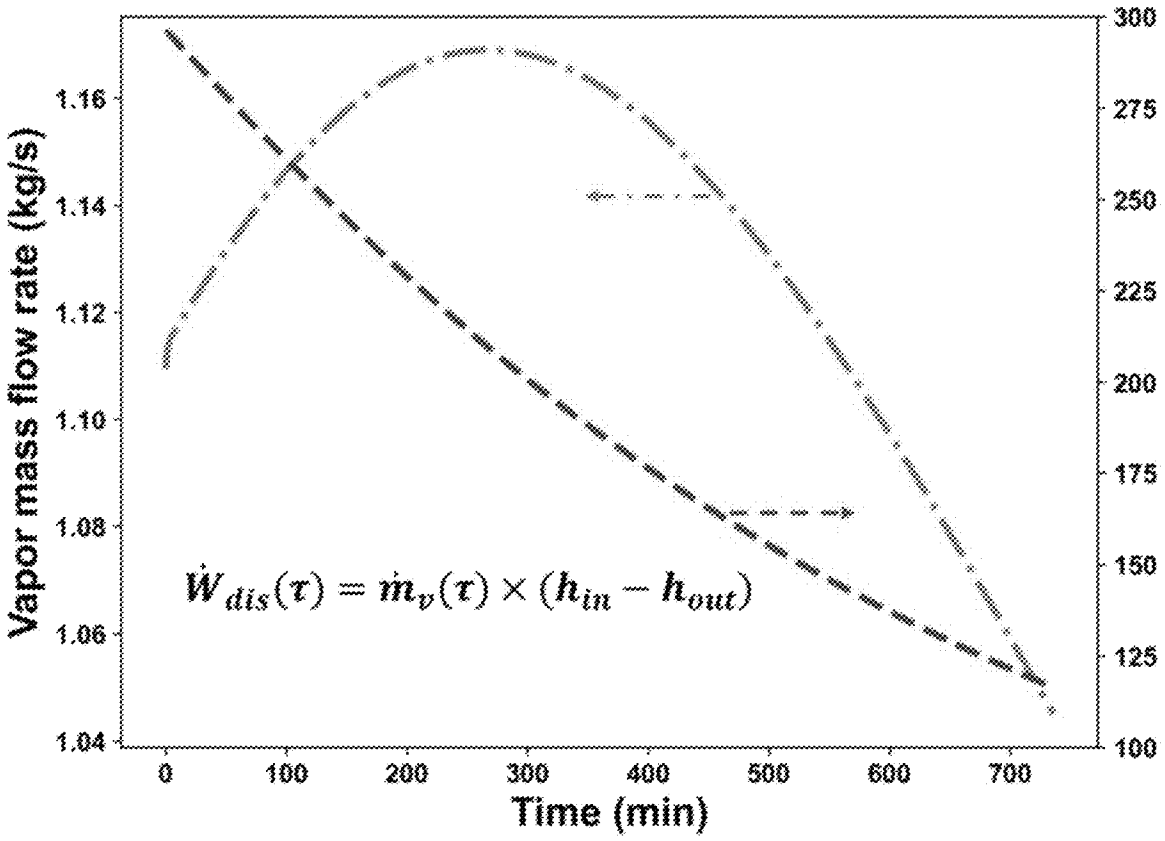
FIG. 5A shows vapor mass flow rate and specific enthalpy difference of the expander over time.
Figure 5B:
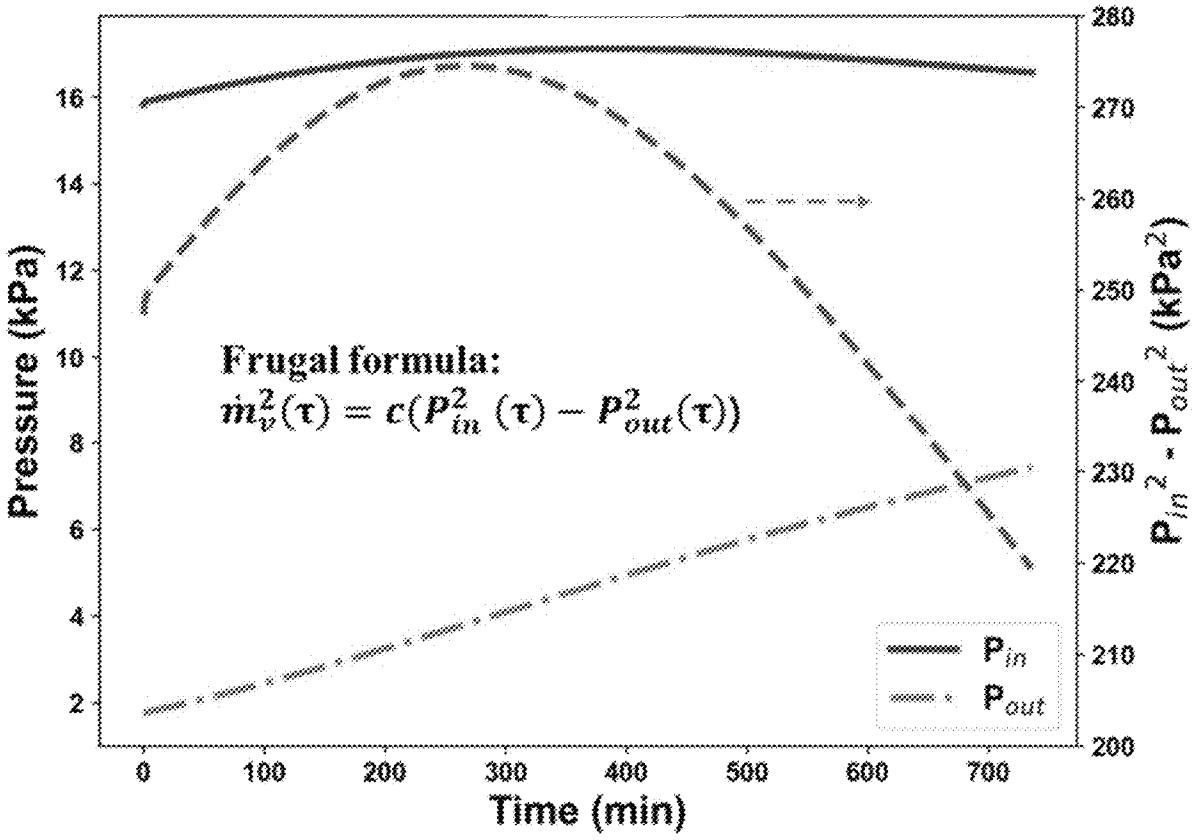
FIG. 5B shows the inlet and outlet pressures of the expander over time.
Figure 6:
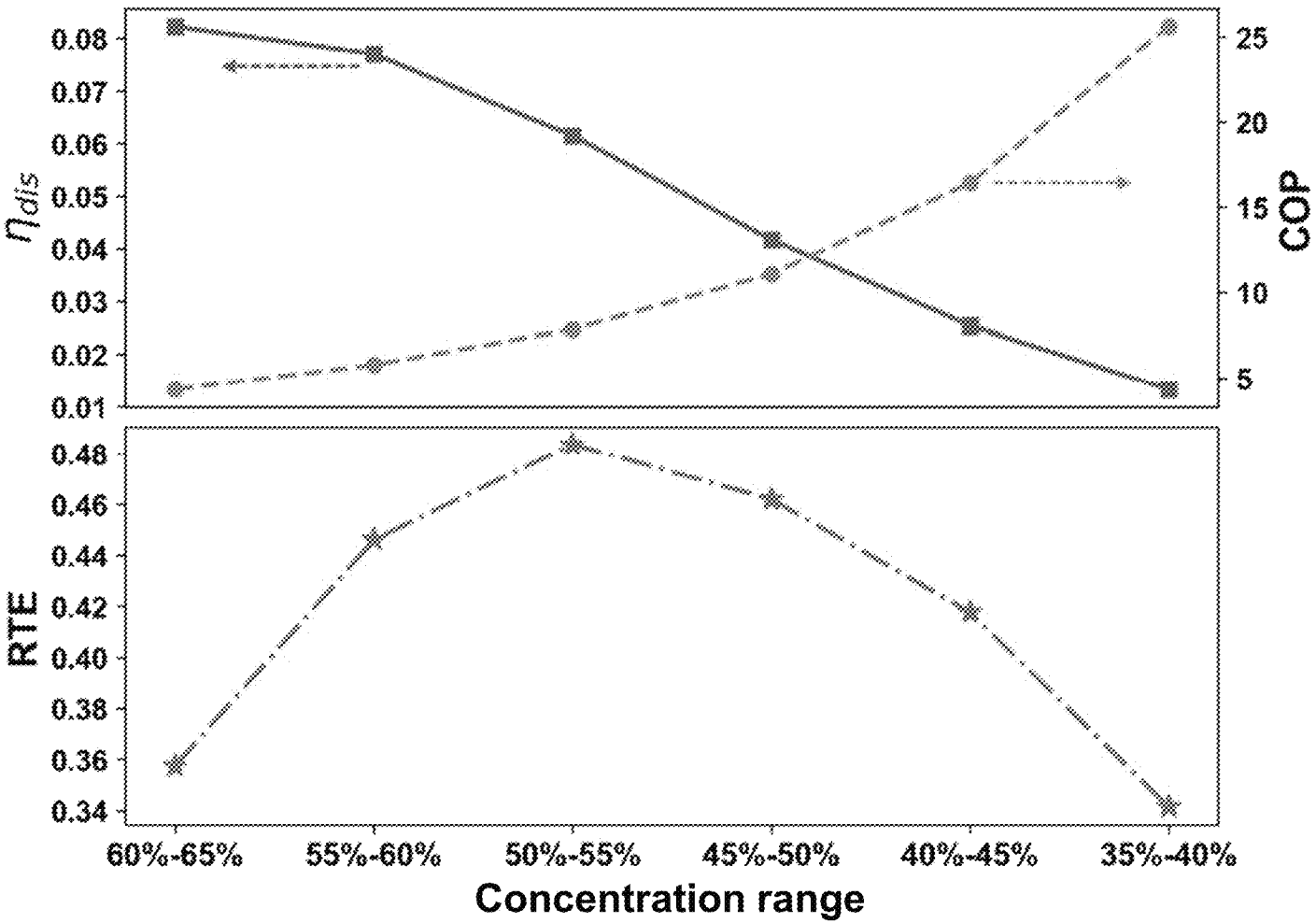
FIG. 6 shows the COP in the charging process, $\eta_{dis}$ in the discharging process, and RTE in the whole process with change concentration ranges.

FIGS. 5A and 5B elucidate why the power output consistently decreases during the discharging process. The power output, a consequence of the product of the vapor mass flow rate through the expander and the specific enthalpy difference between the expander inlet and outlet, is directly governed by these two parameters. As portrayed in FIG. 5A, the vapor mass flow rate initially increases and subsequently decreases during the discharging process, while the specific enthalpy difference continually diminishes. Given that the reduction in specific enthalpy difference significantly outweighs the change in vapor mass flow rate, power output invariably decreases over time. FIG. 5B exhibits the dynamic inlet and outlet pressures of the expander. As the solution concentration declines, the pressure difference and consequently the specific enthalpy difference, as seen in FIG. 5A, diminish. According to the Frugal formula, the square of the mass flow rate is directly proportional to the difference between the square of the expander inlet pressure and expander outlet pressure. Hence, the vapor mass flow rate (FIG. 5A) shows a similar changing trend compared to the squared difference between the inlet and outlet pressures (FIG. 5B).

Therefore, the energy conversion/storage mechanism has been clarified based on the above analysis of the dynamic characteristics of the ACB cycle. During the charging process, the consumed renewable electricity is stored in the form of thermochemical energy represented by a concentration difference. During the discharging process, the vapor refrigerant is absorbed spontaneously by the solution, thereby driving the expander to produce electrical energy for the power grid, with the stored thermochemical energy converted to electricity. The varying temperatures, pressures, concentrations, mass flow rates, powers, and efficiencies of the ACB system are illustrated to elaborate the dynamic characteristics during the charging and discharging processes, which collectively explain the energy conversion and storage mechanism.

2.2 Optimization of the Operating Concentration Range for Performance Improvement The operating concentration range during the charging/discharging processes is one of the most important parameters of the ACB system, which deeply influences energy storage performance. In the section, the effects of operating concentration range on COP, $\eta_{dis}$, RTE, ESD, and PSD are discussed and the optimum concentration range with the best comprehensive performance is optimized based on the TOPSIS decision method.

Figure 7:
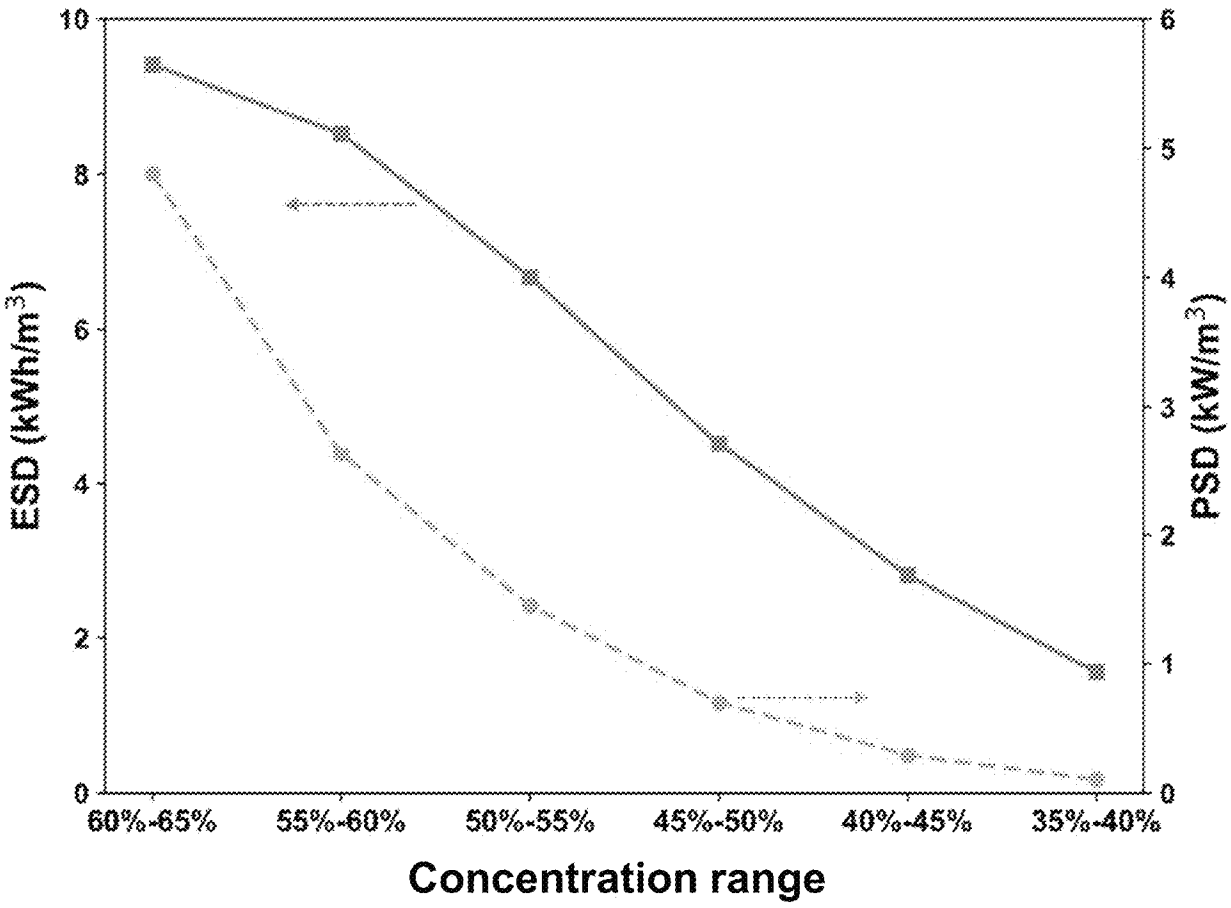
FIG. 7 illustrates the energy storage density and power storage density of the ACB system with changing concentration ranges.
Figure 8:
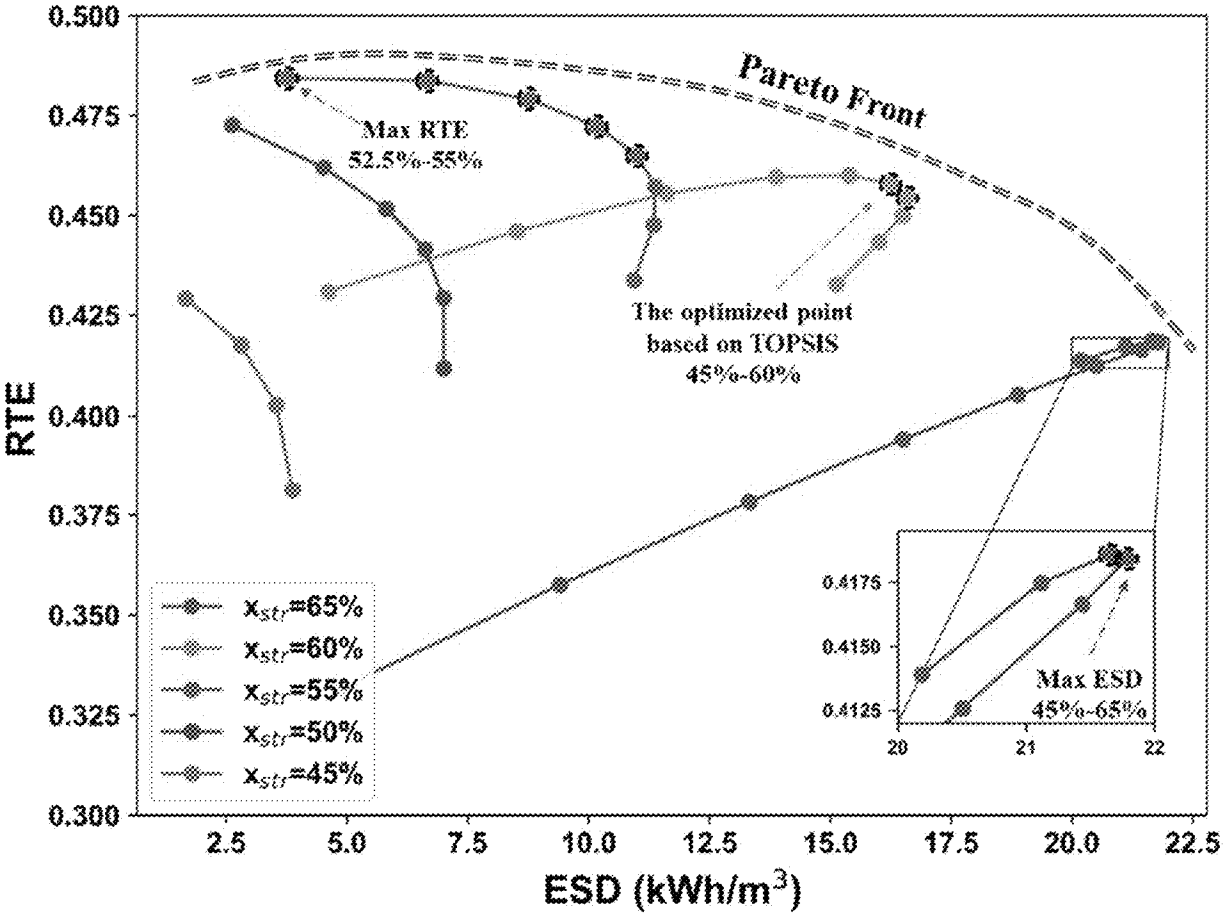
FIG. 8 illustrates the RTE and ESD distributions of the ACB system with different concentration ranges.

The operating concentration range is defined as [$x_{weak}$, $x_{str}$], where xweak and xstr refer to the weak solution concentration (initial charging concentration) and the strong solution concentration (initial discharging concentration), respectively. Take 5% as a concentration glide ($x_{str}-x_{weak}$), FIG. 7 presents the COP in the charging process, $\eta_{dis}$ in the discharging process, and RTE for the overall process with changing concentration ranges. As the concentration of the strong/weak solution reduces, there is a decrease in generation efficiency during discharging and an increase in COP during charging. This trend elucidates why the RTE initially rises and subsequently falls. Hence, an operating concentration range of [50%, 55%] delivers the highest RTE of 48.38% at a fixed concentration gradient of 5%. Correspondingly, the COP and dis are estimated as 8.54 and 5.61%, respectively. FIG. 8 describes the energy storage density and power storage density with changing concentration ranges, assuming a fixed concentration glide of 5%. Both ESD and PSD of the ACB system diminish with the decreasing concentration of the strong/weak solution. The primary cause of this phenomenon is the reduction in power generation efficiency during discharging when $x_{weak}$ and $x_{str}$ decrease, as depicted in FIG. 8.

For large-scale renewable energy storage, RTE and ESD are vital metrics for assessing the energy storage system. Hence, there are sufficient reasons to optimize the operating concentration range with the multi-objective considering RTE and ESD. Herein, a Pareto front is utilized to capture the Pareto-optimal solutions that enhance RTE and ESD performance. Pareto-optimal solutions signify that no superior solution exists that could enhance at least one objective without deteriorating others. In simpler terms, an operating concentration range within the candidate pool is deemed Pareto-optimal if no other points yield higher RTE and ESD values.

With $x_{weak}$ changing from 35% to 62.5% (the changing step is 2.5%) and $x_{str}$ changing from 45% to 65%, FIG. 8 presents the RTE and ESD distributions across all possible operating concentration ranges. The Pareto front is located at the top right of FIG. 9, with 9 points belonging to the Pareto optimal solutions. The Pareto front, situated at the top-right, comprises 9 points, all of which belong to the Pareto-optimal solutions. Among these points, the operating concentration range of [52.5%, 55%] achieves the highest RTE of 48.44%, while the range [45%, 65%] delivers the highest ESD of 21.79 kWh/m$^3$. Guided by the TOPSIS decision-making method, which aims to minimize the distance from the ideal solution and maximize the distance from the worst-case scenario, the optimal operating concentration range of [45%, 60%] is selected. This range offers the best overall performance for the ACB system, with an RTE of 45.80% and an ESD of 16.26 kWh/m$^3$.

2.3 Performance Comparison with Existing Energy Storage Systems

The energy storage performance in the charging/discharging process of the ACB system is first compared with Rankine PTES. For a fair comparison, compressor and expander models in the PTES system are established based on Equations (7-8) and (9-11). R1233zd(E) serves as the working fluid, and unpressurized water is used as the heat storage medium in the PTES system.

Table 6 compares the energy storage performance between ACB and PTES systems without external heat input. The ACB system delivers a higher COP during the charging process, largely because the temperature lift of the heat pump loop is considerably lower than that of the PTES system, leading to less energy consumption during compression. Even though the power generation efficiency is lower, the overall RTE (45.80%) of the ACB system is significantly higher than that of the PTES system (30.04%), due to the considerably higher COP. The ACB system stores energy in a thermochemical form, demonstrated by a concentration difference, resulting in a superior ESD (16.26 kWh/m$^3$) compared to the PTES system (2.10 kWh/m$^3$), which uses common sensible thermal energy storage methods.

TABLE 6

| | COP | $\eta_{dis}$ | RTE | ESD (kWh/m$^3$) |
|---|---|---|---|---|
| ACB | 7.905 | 0.0579 | 45.80% | 16.26 |
| PTES | 3.329 | 0.0903 | 30.04% | 2.10 |

Figure 9:
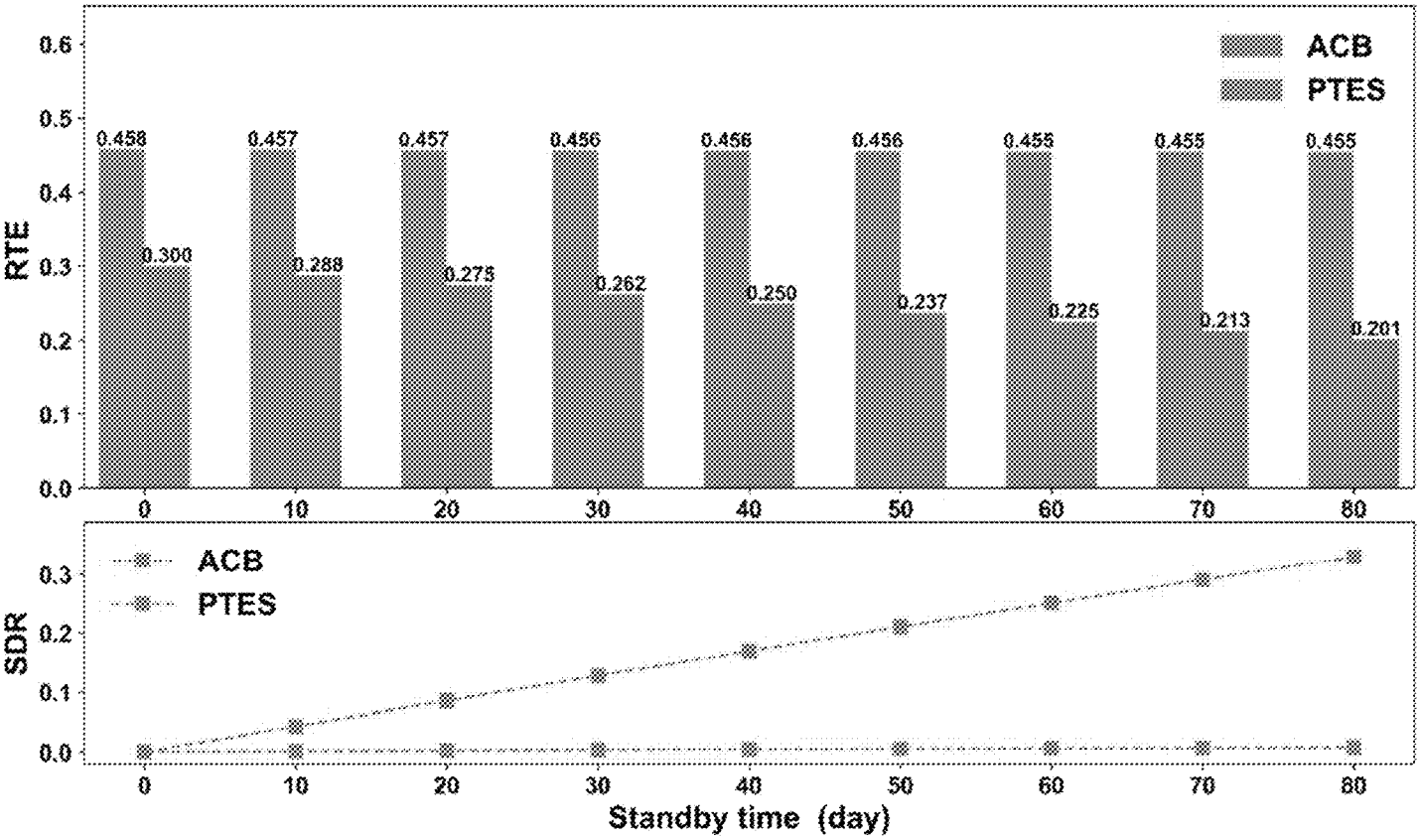
FIG. 9 illustrates a comparison between the change in the RTEs and SDRs of the ACB and PTES systems over increasing standby time.

FIG. 9 compares the RTEs and SDRs of the ACB and PTES systems over a standby time range from 0 to 80 days. As the standby time increases, the SDR of the PTES system escalates due to persistent sensible heat loss, resulting in noticeable RTE degradation. In contrast, the self-discharge rate of the ACB system is almost negligible because the majority of heat input is stored thermochemically, which is reflected by a concentration difference between the solution and refrigerant. The thermochemical energy stored in the ACB system remains entirely stable during standby, and only the sensible heat of the tanks (which accounts for a small portion of the heat input) can dissipate into the surrounding environment, causing the RTE to decrease very slowly. Even after 80 days of standby time, the SDR of the ACB system is merely 0.74%, while that of the PTES system reaches 33.01%, thus highlighting the advantage of the ACB system in minimizing self-discharge.

Figure 10:
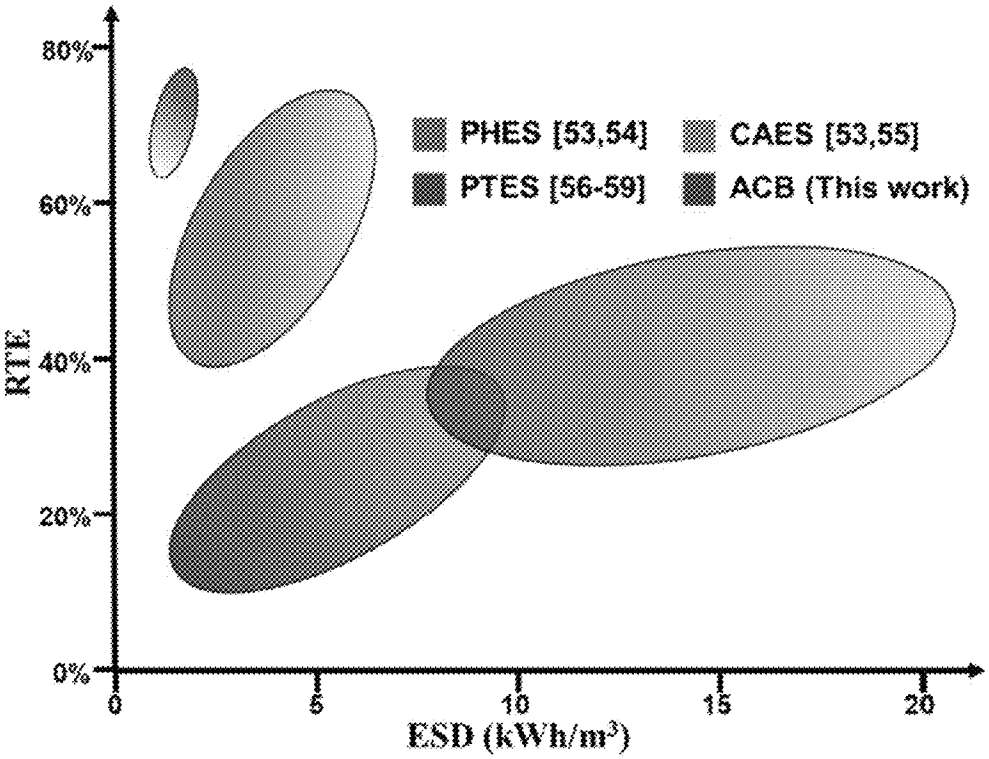
FIG. 10 shows the comparison between the performance of existing energy storage systems with the ACB in the present invention.

Considering RTE and ESD as the most important indicators for large-scale renewable energy storage, FIG. 10 presents the performance comparison between the PHES technology, CAES technology, ACB technology, and PTES technology. The PHES system yields the highest RTE (65%-75%) but the lowest ESD (0.2-4 kWh/m$^3$) as it stores energy in the form of gravitational potential. The CAES system exhibits a lower RTE (41%-75%) and a higher ESD (2-6 kWh/m$^3$) compared to the PTES system. Although the PTES system has a considerably lower RTE (14%-36.1%) than the PHES and CAES systems, it yields a higher ESD, with a range of 1-11.1 kWh/m3. Compared to the aforementioned technologies, the ACB system offers a competitive RTE (30.5%-48.4%) and a significantly higher ESD (7.6-21.8 kWh/m$^3$), implicating that it is a promising technology for potential application in large-scale renewable energy storage.

2.4 Techno-Economic Analysis

In this section, the economic performance of the ACB and PTES systems is investigated based on the life-cycle assessment. The parameter settings and the initial cost models of the ACB system are provided in Table 3 and Table 5, respectively. Other necessary parameters like compressor power, expander power, motor power, and solution power are derived from the dynamic cycle models. Both the ACB and PTES systems are designed to complete a full cycle in a day, operate for 300 days per year, and have identical storage tank sizes. According to the above analysis, the RTE and ESD of the ACB system respectively reach 45.80% and 16.26 kWh/m$^3$ under this condition, better than those of the PTES system RTE of 30.04% and ESD of 2.10 kWh/m$^3$). An operating strategy considering time-of-use (TOE) electricity price is applied for the ACB and PTES systems to save operating costs.

Table 7 below presents the economic performance comparison between the ACB and PTES systems. Firstly, the initial cost of the ACB system is significantly higher than that of PTES, primarily due to the escalating price of lithium salt. In the ACB system, the working pair cost accounts for the most substantial part (68.5%) of the total initial cost. Additionally, the costs associated with the compressor, expander, and motor in the ACB system exceed those in the PTES system due to the higher power input/output requirements. Secondly, the environmental cost of the ACB (51.12 k$/year) is also higher than that of PTES (15.63 k$/year) as it stores considerably more energy, which subsequently increases environmental costs. Thirdly, owing to the high RTE, the ACB system has a negative operating cost, implying that it generates profits from the time-of-use (TOU) pricing policy. By implementing this operating strategy, the ACB system generates earnings of 11.47 k$/year, whereas the PTES system incurs an annual operating cost of 3.21 k$.

TABLE 7

| Items | ACB | PTES |
|---|---|---|
| Initial cost (k$) | 2044.94 | 625.26 |
| Environmental cost (k$) | 62.28 | 26.47 |
| Maintenance cost (k$/year) | 51.12 | 15.63 |
| Operating cost (k$/year) | −11.47 | 3.21 |
| Energy storage amount (MWh/year) | 609.60 | 120.78 |
| LCOS ($/kWh) | 0.290 | 0.507 |

Figure 11:
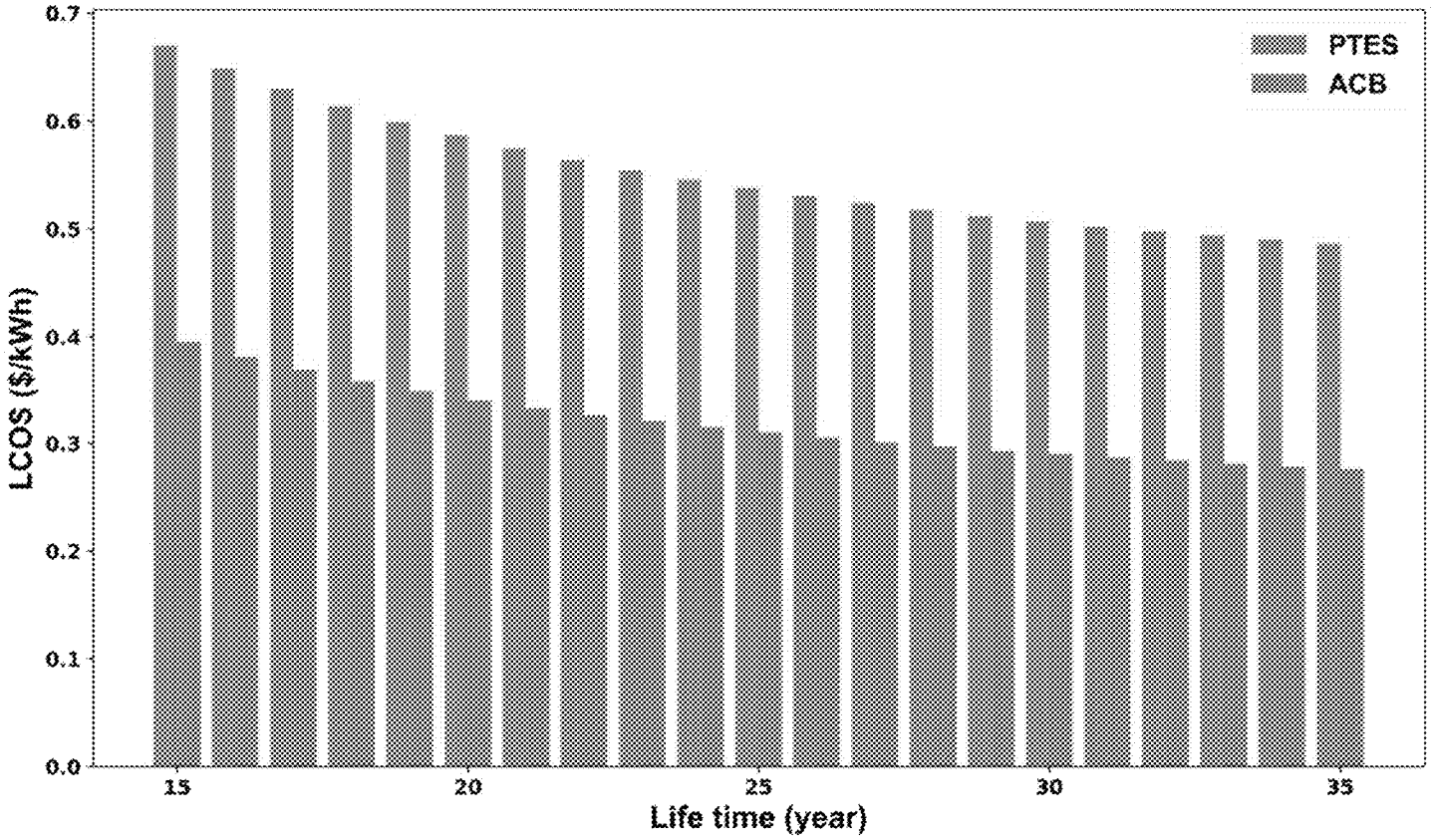
FIG. 11 compares the levelized cost of storage of the ACB and PTES systems with different lifetimes.

Finally, despite the ACB system having higher initial, environmental, and maintenance costs, its LCOS of 0.290 $/kWh is substantially lower than 0.507 $/kWh of the PTES system, owing to its superior ESD. FIG. 11 illustrates the LCOS comparisons between the ACB and PTES systems over various lifetimes. As the system lifetimes extend, the LCOS values continue to decrease due to lower marginal costs. The ACB system consistently has lower LCOS values (0.276-0.395 $/kWh) than the PTES system (0.486-0.670 $/kWh), underscoring the economic viability of the ACB system for largescale renewable energy storage.

As used herein, terms "approximately", "basically", "substantially", and "about" are used for describing and explaining a small variation. When being used in combination with an event or circumstance, the term may refer to a case in which the event or circumstance occurs precisely, and a case in which the event or circumstance occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all the ranges disclosed in the present disclosure include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

The invention claimed is:

1. An absorption-desorption-based Carnot battery system for electrical energy storage, comprising:

a solution repository including at least one solution tank for thermochemical energy storage, the solution being reversibly capable storing and releasing refrigerant;

a refrigerant repository including at least one refrigerant tank for thermochemical energy storage;

an expander for heat-to-power energy conversion;

a compressor for power-to-heat energy conversion;

an external vapor-compression heat pump loop positioned between the solution tank and the refrigerant tank and including heating and cooling loops and the compressor for receiving surplus electricity from a renewable energy source to generate heat and raise a temperature of the solution during a charging cycle and generating refrigerant vapor in the solution tank;

a vapor communication pathway between the solution tank and the refrigerant tank for receiving refrigerant vapor from solution or refrigerant tank and passing to the other tank, an internal heat loop between the refrigerant tank and the solution tank, the internal heat loop including reducing the temperature difference between the solution and refrigerant tanks in the pre-discharging process, recovering the absorption heat in the discharging process, and recapturing the condensation heat in the charging process;

a controller to maintain the internal heat exchange pathway open and open the external heating and cooling loop during a pre-charging cycle to cool the refrigerant tank and the solution tank to reduce a temperature differential between the refrigerant tank and the solution tank.

2. The absorption-desorption-based Carnot battery system of claim 1, wherein the solution comprises an absorbent is selected from salts, ionic liquids or deep eutectic solvents.

3. The absorption-desorption-based Carnot battery system of claim 1, wherein the refrigerant is selected from water, ammonia, hydrofluorocarbon, alcohol, hydrofluoroolefin or carbon dioxide.

4. The absorption-desorption-based Carnot battery system of claim 1, wherein the round-trip efficiency of the battery is at least 30.0%.

5. The absorption-desorption-based Carnot battery system of claim 1, wherein the energy storage density of the battery is at least 7.0 $kWh/m^3$.

6. The absorption-desorption-based Carnot battery system of claim 1, wherein the self-discharging rate of the battery is lower than 1% after 80 days of standby.

7. The absorption-desorption Carnot battery-based thermochemical energy storage system of claim 1, wherein the optimum operation concentration of the solution is 45% to 60%.

8. A method of operation of the absorption-desorption-based Carnot battery system of claim 1, wherein the method includes an operation cycle comprising:

a charging process;

a pre-discharging process;

a discharging process; and a pre-charging process.

9. The method of claim 8, wherein during the charging process, the configuration of the battery comprises:

opening of first valve;

closing of second valve;

closing of third valve;

closing of internal heat exchange loop;

opening of external cooling loop; and opening of external heating loop.

10. The method of claim 8, wherein during the pre-discharging process, the configuration of the battery comprises:

closing of first valve;

closing of second valve;

closing of third valve;

opening of internal heat exchange loop;

closing of external cooling loop; and closing of external heating loop.

11. The method of claim 8, wherein during the discharging process, the configuration of the battery comprises:

closing of first valve;

opening of second valve;

opening of third valve;

opening of internal heat exchange loop;

closing of external cooling loop; and closing of external heating loop.

12. The method of claim 8, wherein during the pre-charging process, the configuration of the battery comprises:

closing of first valve;

closing of second valve;

closing of third valve;

opening of internal heat exchange loop;

closing of external cooling loop; and opening of external heating loop.

13. The method of the absorption-desorption-based Carnot battery system of claim 8 for power-cooling energy storage, wherein the discharging process is configured for cooling.

14. The method of the absorption-desorption-based Carnot battery system of claim 8 for power-heating energy storage, wherein the discharging process is configured for heating.

* * * * *